US006945636B2

(12) United States Patent
Sakaida et al.

(10) Patent No.: US 6,945,636 B2
(45) Date of Patent: Sep. 20, 2005

(54) INK-JET HEAD, METHOD FOR MANUFACTURING INK-JET HEAD AND INK-JET PRINTER HAVING INK-JET HEAD

(75) Inventors: Atsuo Sakaida, Gifu (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/369,609

(22) Filed: Feb. 21, 2003

(65) Prior Publication Data

US 2003/0156156 A1 Aug. 21, 2003

(30) Foreign Application Priority Data

Feb. 21, 2002 (JP) ..... 2002-044080
Feb. 21, 2002 (JP) ..... 2002-044134

(51) Int. Cl.[7] ..... B41J 2/045; B41J 2/05
(52) U.S. Cl. ..... 347/68; 347/65
(58) Field of Search ..... 347/65, 68, 71, 347/40–43, 20, 44, 47, 72; 29/890.1

(56) References Cited

U.S. PATENT DOCUMENTS 5,670,999 A * 9/1997 Takeuchi et al. ..... 347/70
5,895,313 A 4/1999 Ikezaki et al. ..... 451/38
6,003,968 A 12/1999 Kozawa ..... 347/20
6,161,926 A * 12/2000 Shigemura et al. ..... 347/71
6,338,551 B1 * 1/2002 Sugiura et al. ..... 347/71

FOREIGN PATENT DOCUMENTS

JP 9-57964 3/1997

OTHER PUBLICATIONS

Author Unknown, Hydrogenated Silicon Carbide Membrane Nozzle, 1980, IBM Technical Disclosure, vol. 23 Issue 5 p. 2142.*

* cited by examiner

*Primary Examiner*—Thinh Nguyen
(74) *Attorney, Agent, or Firm*—Oliff & Berridge, PLC

(57) ABSTRACT

An ink-jet head includes a passage unit including a nozzle plate unit having a nozzle plate in which nozzles are formed, and a main unit fixed on the nozzle plate unit in a laminating direction and having a plurality of pressure chambers, each of the plurality of pressure chambers having one end connected with a nozzle and an other end connected with an ink supply source, the plurality of pressure chambers arranged along a plane to neighbor each other, and an actuator unit, fixed on a side of the main unit opposite to a side in which the main unit is fixed on the nozzle plate unit, for changing the volume of each of said pressure chambers.

24 Claims, 17 Drawing Sheets

INK-JET HEAD, METHOD FOR MANUFACTURING INK-JET HEAD AND INK-JET PRINTER HAVING INK-JET HEAD

BACKGROUND OF THE INVENTION

1. Field of Invention

The invention relates to an ink-jet head for printing by ejecting ink onto a record medium, to a method for manufacturing the ink-jet head, and to an ink-jet printer having the ink-jet head.

2. Description of Related Art

In an ink-jet printer, an ink-jet head distributes ink, which is supplied from an ink tank, to pressure chambers. The ink-jet head selectively applies pulse pressure to each pressure chamber to eject ink through a nozzle connected with each pressure chamber. As a means for selectively applying pulse pressure to the pressure chambers, an actuator unit or the like may be used in which ceramic piezoelectric sheets are laminated. The printing operations are carried out while reciprocating such a head at a high speed in the widthwise direction of paper.

In the ink-jet head of the related art, a pressure chamber and an ink passage are formed by subjecting the piezoelectric ceramics to a cutting operation with a diamond cutter. Individual electrodes or driving electrodes made of a metallic film are formed over the actuator units corresponding to the individual pressure chambers. On the surface of the ink passage on the lower side of the pressure chamber, there is disposed a nozzle plate, which is made of a synthetic resin film and has a number of ink ejection ports.

However, the manufacturing costs for the aforementioned ink-jet head of the related art is high because the head main body is made of piezoelectric ceramics. The manufacturing costs is further raised by the cutting operation which uses the diamond cutter.

As a solution for the aforementioned cost problems, there is known an inkjet head constructed such that a passage unit, having one-dimensionally arranged pressure chambers and ink passages made of relatively inexpensive and easily workable metal plates, and an actuator unit, using a continuous flat plate layer of piezoelectric ceramics spanning across the pressure chambers, are fixed on each other. If the passage unit is constructed by inexpensive metal plates, the cost for the material can be suppressed. Moreover, the manufacturing costs can also be suppressed by using metal plates, because metal plates are more workable than piezoelectric ceramics and can be finely lightened at many points by etching them.

Here, for fixing different materials of the metal and the piezoelectric ceramics, it is preferable to use a room temperature setting adhesive for easy bonding operations. In order to obtain a sufficient adhesion strength and resistance, however, a heat setting adhesive has to be used to bond the two materials in a heated state. Since there is a large difference in the linear expansion coefficient between the metal and the piezoelectric ceramics, when they are bonded in the heated state, the passage unit having a larger linear expansion coefficient shrinks more than the actuator unit, in a facial direction, when returned to the room temperature. Therefore, the ink-jet head warps and is convex toward the actuator unit. This warp causes poor printing and deterioration in a production yield.

SUMMARY OF THE INVENTION

The invention thus provides an ink-jet head capable of relaxing a warp which can cause poor printing and deterioration in a production yield, to provide a method for manufacturing the ink-jet head, and to provide an ink-jet printer having the ink-jet head.

According to a first exemplary aspect of the invention, there is provided an ink-jet head including a passage unit including a nozzle plate unit having a nozzle plate in which nozzles are formed, and a main unit fixed on the nozzle plate unit in a laminating direction and having a plurality of pressure chambers, each of the plurality of pressure chambers having one end connected with a nozzle and an other end connected with an ink supply source, the plurality of pressure chambers arranged along a plane to neighbor each other, and an actuator unit fixed on a side of the main unit opposite to a side in which the main unit is fixed on the nozzle plate unit, for changing the volume of each of the pressure chambers. A linear expansion coefficient of a material making the actuator unit is smaller than that of a material making the main unit, and a linear expansion coefficient of a material making the nozzle plate unit is smaller than that of the material making the main unit.

According to a second exemplary aspect of the invention, there is provided a method for manufacturing an ink-jet head including a passage unit including a nozzle plate unit having a nozzle plate in which nozzles are formed, and a main unit having a plurality of pressure chambers, each of the plurality of pressure chambers having one end connected with a nozzle and an other end connected with an ink supply source, the plurality of pressure chambers arranged along a plane to neighbor each other, and an actuator unit for changing the volume of each of the pressure chambers. The method comprises a step of fixing the nozzle plate unit and the main unit, with the main unit made of a material having a linear expansion coefficient larger than that of a material making the nozzle plate unit, in a heated state in a laminating direction, and a step of fixing the actuator unit, with the actuator unit made of a material having a linear expansion coefficient smaller than that of the material making the main unit, on a side of the main unit opposite to a side in which the main unit is fixed with the nozzle plate unit, in a heated state.

In this construction, on two surfaces of a main unit in a passage unit, there are respectively fixed a nozzle plate unit and an actuator unit, both of which are made of materials having smaller linear expansion coefficients than that of the main unit. As a result, a warp in the ink-jet head can be relaxed even when the ink-jet head is fixed in the heated state. Moreover, since the warp is relaxed, such problems as poor printing and deterioration in a production yield can be lightened.

Here, the nozzle plate unit means either one nozzle plate disposed in the lowermost layer of the passage unit opposite to the actuator unit bonded thereon, or one nozzle plate and one or more plates adjacent to the nozzle plate.

According to a third exemplary aspect of the invention, there is provided an ink-jet head including a passage unit including a plurality of pressure chambers each having one end connected with a nozzle and an other end connected with an ink supply source, the plurality of pressure chambers being arranged along a plane to neighbor each other, an actuator unit fixed on a surface of the passage unit for changing a volume of the pressure chambers, and a support member arranged over a plane of the actuator unit and facing a direction opposite to the passage unit. A linear expansion coefficient of a material making the passage unit is larger than that of a material making the actuator unit, and a linear expansion coefficient of a material making the support member is larger than that of the material making the actuator unit.

According to a fourth exemplary aspect of the invention, there is provided a method for manufacturing an ink-jet head including a passage unit including a plurality of pressure chambers each having one end connected with a nozzle and an other end connected with an ink supply source, the plurality of pressure chambers being arranged along a plane to neighbor each other and an actuator unit for changing the volume of the pressure chambers. The method comprises a step of fixing the actuator unit, which is made of a material having a linear expansion coefficient smaller than that of a material making the passage unit, in a heated state on a surface of the passage unit, and a step of arranging a support member, which is made of a material having a larger linear expansion coefficient than that of the material making the actuator unit, over a plane of the actuator unit and facing a direction opposite to the passage unit.

In this construction, on one face of an actuator unit, there is fixed a passage unit made of a material having a linear expansion coefficient larger than that of a material making the actuator unit, in the heated state, whereas on the other face of the actuator unit, there is arranged a support member made of a material having a linear expansion coefficient larger than that of the actuator unit. As a result, a warp in the ink-jet head can be relaxed. Moreover, since the warp is relaxed, such problems as poor printing and deterioration in a production yield can be lightened.

Here, the actuator unit and the support member may or may not be bonded to each other. The support member and the actuator unit may contact each other or may be spaced from each other.

According to a fifth exemplary aspect of the invention, there is provided an ink-jet head including a passage unit including a plurality of pressure chambers each having one end connected with a nozzle and an other end connected with an ink supply source, the plurality of pressure chambers being arranged along a plane to neighbor each other, actuator units fixed in a staggered shape on a surface of the passage unit for changing the volume of the pressure chambers, and a support member arranged over a plane of the actuator units and facing a direction opposite to the passage unit and having a plurality of staggeringly arranged fixing portions fixed on a surface of the passage unit except for a region where the actuator units are fixed on the passage unit. The fixing portions of the support member and the actuator units are arranged adjacent to each other on the surface of the passage unit. A linear expansion coefficient of a material making the passage unit is larger than that of a material making the actuator units, and a linear expansion coefficient of a material making the support member is larger than that of the material making the actuator units.

According to a sixth exemplary aspect of the invention, there is provided a method for manufacturing an ink-jet head including a passage unit including a plurality of pressure chambers each having one end connected with a nozzle and an other end connected with an ink supply source, the plurality of pressure chambers being arranged along a plane to neighbor each other, actuator units for changing the volume of the pressure chambers, and a support member arranged over a plane of the actuator units and facing a direction opposite to the passage unit. The method comprises a step of fixing the actuator units, which are made of a material having a linear expansion coefficient smaller than that of a material making the passage unit, in a heated state so that they are arranged in a staggered shape on a surface of the passage unit, and a step of fixing the support member, which is made of a material having a linear expansion coefficient larger than that of the material making the actuator units, on the passage unit except for a region where the actuator units are fixed on the passage unit so that a plurality of fixing portions are arranged in a staggered shape on the surface of the passage unit.

In this construction, actuator units and fixing portions of a support member on a surface of a passage unit are fixed on the surface of the passage unit and are staggered from each other. Then, a warp, as might otherwise be caused due to the difference in the linear expansion coefficient between the passage unit and the actuator unit, is more effectively relaxed. Since the actuator unit has a smaller linear expansion coefficient than that of the passage unit, a warp convex toward the actuator unit occurs in each of the portions on the surface of the passage unit where the actuator units are fixed. In case the actuator units are fixed in one row on the surface of the passage unit in the longitudinal direction, for example, a warp occurs in an offset state concentratedly along the longitudinal direction where the actuator units are fixed. This kind of offset warp is not sufficiently relaxed even if the support member is fixed on the region of the passage unit where the actuator units are not fixed. On the other hand, when the actuator units are fixed in a staggered shape on the surface of the passage unit and the support member having a larger linear expansion coefficient than that of the actuator units is fixed on the passage unit except the region where the actuator units are fixed so that its fixing portions are arranged in a staggered shape on the surface of the passage unit, the warp is not offset all over the surface of the passage unit. As a result, the warp can be effectively relaxed. Moreover, since the warp is relaxed, such problems as poor printing and deterioration in a production yield can be lightened.

BRIEF DESCRIPTION OF THE DRAWINGS

Other and further objects, features and advantages of the invention will appear more fully from the following description taken in connection with the accompanying drawings in which.

DETAILED DESCRIPTION OF PREFERRED EMBODIMENTS

Figure 1:
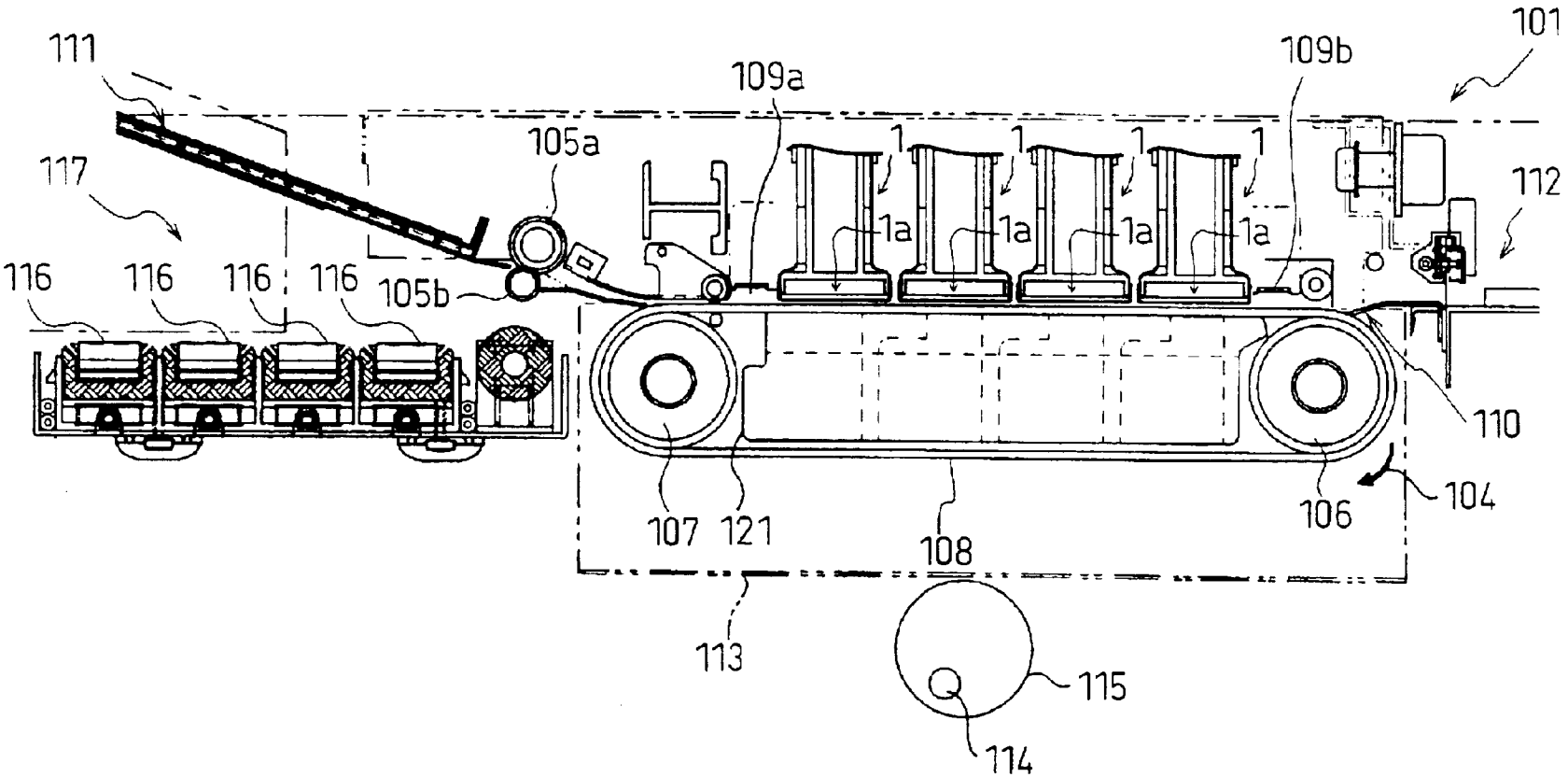
FIG. 1 is a general view of an ink-jet printer including ink-jet heads according a first embodiment of the invention.

FIG. 1 is a general view of an ink-jet printer including ink-jet heads according to a first embodiment of the invention. The ink-jet printer 101 as illustrated in FIG. 1 is a color ink-jet printer having four ink-jet heads 1. In this printer 101, a paper feed unit 111 and a paper discharge unit 112 are disposed in left and right portions of FIG. 1, respectively.

In the printer 101, a paper transfer path is provided extending from the paper feed unit 111 to the paper discharge unit 112. A pair of feed rollers 105*a* and 105*b* is disposed immediately downstream of the paper feed unit 111 for pinching and putting forward a paper as an image record medium. By the pair of feed rollers 105*a* and 105*b*, the paper is transferred from the left to the right in FIG. 1. In the middle of the paper transfer path, two belt rollers 106 and 107 and an endless transfer belt 108 are disposed. The transfer belt 108 is wound on the belt rollers 106 and 107 to extend between them. The outer face, i.e., the transfer face, of the transfer belt 108 has been treated with silicone. Thus, a paper fed through the pair of feed rollers 105*a* and 105*b* can be held on the transfer face of the transfer belt 108 by the adhesion of the face. In this state, the paper is transferred downstream (rightward) by driving one belt roller 106 to rotate clockwise in FIG. 1 (the direction indicated by an arrow 104).

Pressing members 109*a* and 109*b* are disposed at positions for feeding a paper onto the belt roller 106 and taking out the paper from the belt roller 106, respectively. Either of the pressing members 109*a* and 109*b* is for pressing the paper onto the transfer face of the transfer belt 108 so as to prevent the paper from separating from the transfer face of the transfer belt 108. Thus, the paper surely adheres to the transfer face.

A peeling device 110 is provided immediately downstream of the transfer belt 108 along the paper transfer path. The peeling device 110 peels off the paper, which has adhered to the transfer face of the transfer belt 108, from the transfer face to transfer the paper toward the rightward paper discharge unit 112.

Each of the four ink-jet heads 1 has, at its lower end, a head main body 1*a*. Each head main body 1*a* has a rectangular section. The head main bodies 1*a* are arranged close to each other with the longitudinal axis of each head main body 1*a* being perpendicular to the paper transfer direction (perpendicular to FIG. 1). That is, this printer 101 is a line type. The bottom of each of the four head main bodies 1*a* faces the paper transfer path. In the bottom of each head main body 1*a*, a number of nozzles are provided each having a small-diameter ink ejection port. The four head main bodies 1*a* eject ink of magenta, yellow, cyan, and black, respectively.

The head main bodies 1*a* are disposed such that a narrow clearance must be formed between the lower face of each head main body 1*a* and the transfer face of the transfer belt 108. The paper transfer path is formed within the clearance. In this construction, while a paper, which is being transferred by the transfer belt 108, passes immediately below the four head main bodies 1*a* in order, the respective color inks are ejected through the corresponding nozzles toward the upper face, i.e., the print face, of the paper to form a desired color image on the paper.

The ink-jet printer 101 is provided with a maintenance unit 117 for automatically carrying out maintenance of the ink-jet heads 1. The maintenance unit 117 includes four caps 116 for covering the lower faces of the four head main bodies 1*a*, and a not-illustrated purge system.

The maintenance unit 117 is at a position immediately below the paper feed unit 111 (withdrawal position) while the ink-jet printer 101 operates to print. When a predetermined condition is satisfied after finishing the printing operation (for example, when a state in which no printing operation is performed continues for a predetermined time period or when the printer 101 is powered off), the maintenance unit 117 moves to a position immediately below the four head main bodies 1*a* (cap position), where the maintenance unit 117 covers the lower faces of the head main bodies 1*a* with the respective caps 116 to prevent ink in the nozzles of the head main bodies 1*a* from being dried.

The belt rollers 106 and 107 and the transfer belt 108 are supported by a chassis 113. The chassis 113 is put on a cylindrical member 115 disposed under the chassis 113. The cylindrical member 115 is rotatable around a shaft 114 provided at a position deviating from the center of the cylindrical member 115. Thus, by rotating the shaft 114, the level of the uppermost portion of the cylindrical member 115 can be changed to move up or down the chassis 113 accordingly. When the maintenance unit 117 is moved from the withdrawal position to the cap position, the cylindrical member 115 must have been rotated at a predetermined angle in advance so as to move down the transfer belt 108 and the belt rollers 106 and 107 by a pertinent distance from the position illustrated in FIG. 1. A space for the movement of the maintenance unit 117 is thereby ensured.

In the region surrounded by the transfer belt 108, a nearly rectangular parallelepiped guide 121 (having its width substantially equal to that of the transfer belt 108) is disposed at an opposite position to the ink-jet heads 1. The guide 121 is in contact with the lower face of the upper part of the transfer belt 108 to support the upper part of the transfer belt 108 from the inside.

Figure 2:
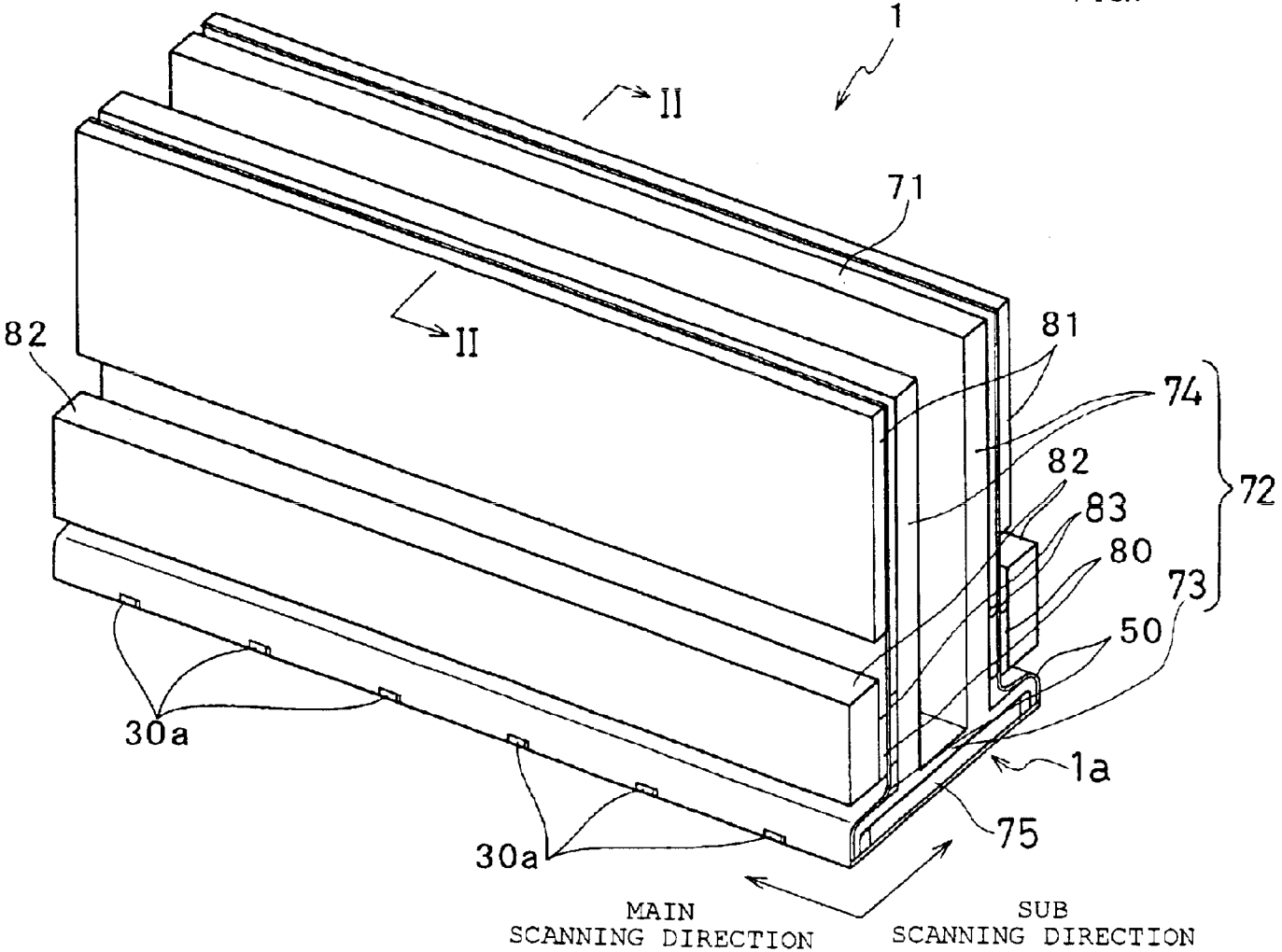
FIG. 2 is a perspective view of a head main body according to the first embodiment of the invention.
Figure 3:
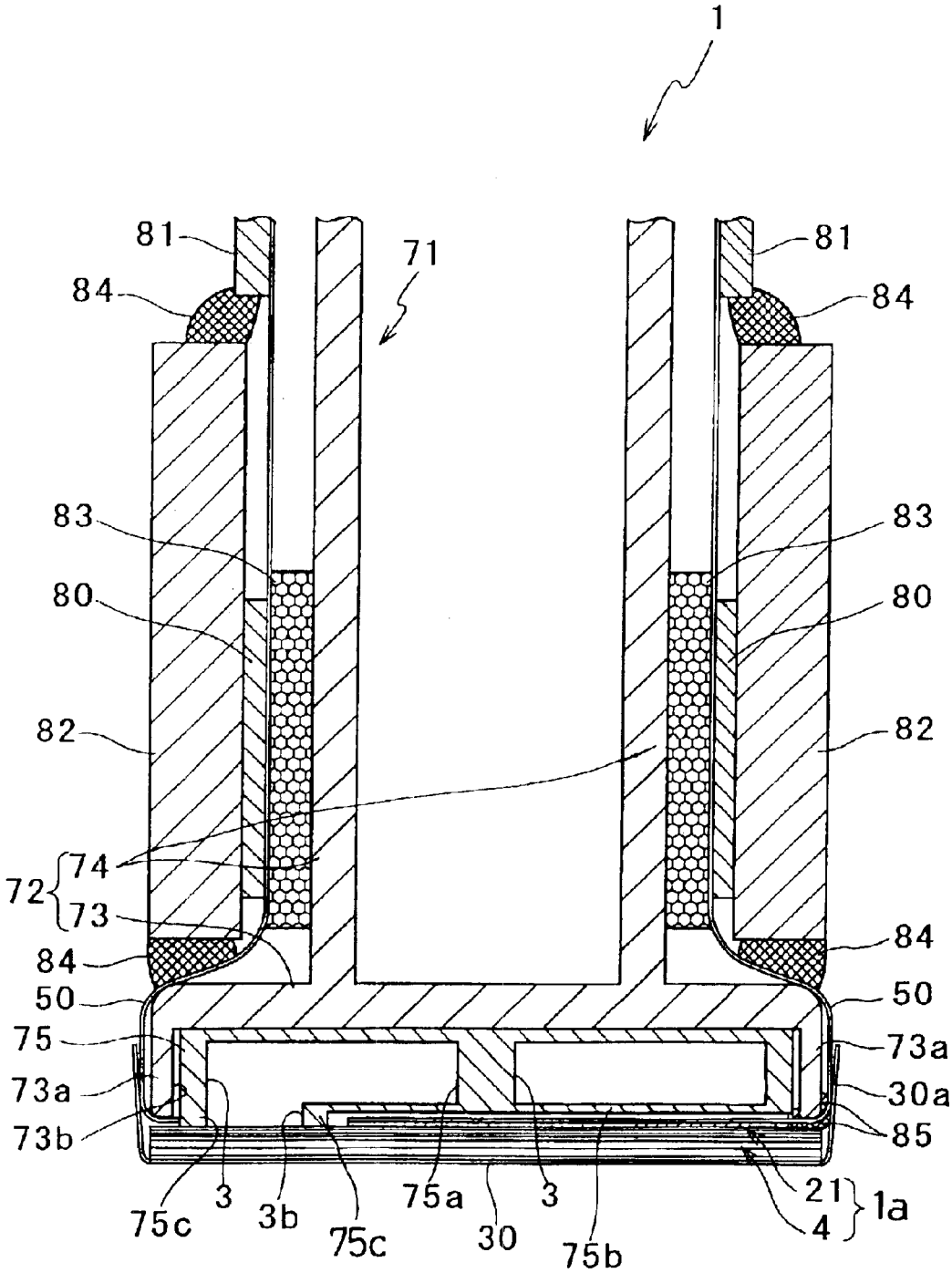
FIG. 3 is a sectional view taken along line II—II in FIG. 2.

Next, the construction of each ink-jet head 1 according to this embodiment will be described in more detail. FIG. 2 is a perspective view of the ink-jet head 1. FIG. 3 is a sectional view taken along line II—II in FIG. 2. Referring to FIGS. 2 and 3, the ink-jet head 1 according to this embodiment includes a head main body 1*a* having a rectangular shape in a plan view and extending in one direction (main scanning direction), and a base portion 71 for supporting the head main body 1*a*. The base portion 71 supporting the head main body 1*a* further supports thereon driver ICs 80 for supplying driving signals to individual electrodes 35*a* and 35*b* (see FIG. 11A), and substrates 81.

Referring to FIG. 2, the base portion 71 is made up of a base block 75 partially bonded to the upper face of the head main body 1*a* to support the head main body 1*a*, and a holder 72 bonded to the upper face of the base block 75 to support the base block 75. The base block 75 is a nearly rectangular parallelepiped member having substantially the same length of the head main body 1*a*. The base block 75 is made of metal material such as stainless steel and functions as a light structure for reinforcing the holder 72. The holder 72 is made up of a holder main body 73 disposed near the head main body 1*a*, and a pair of holder support portions 74 each extending on the opposite side of the holder main body 73 to the head main body 1*a*. Each holder support portion 74 is a flat member. These holder support portions 74 extend along the longitudinal direction of the holder main body 73 and are disposed in parallel with each other at a predetermined interval.

Skirt portions 73*a* in a pair, protruding downward, are provided on both end portions of the holder main body 73 in a sub scanning direction (perpendicular to the main scanning direction). Either skirt portion 73*a* is formed through the length of the holder main body 73. As a result, in the lower portion of the holder main body 73, a nearly rectangular parallelepiped groove 73*b* is defined by the pair of skirt portions 73*a*. The base block 75 is received in the groove 73*b*. The upper surface of the base block 75 is bonded to the bottom of the groove 73*b* of the holder main body 73 with an adhesive. The thickness of the base block 75 is somewhat larger than the depth of the groove 73*b* of the holder main body 73. As a result, the lower end of the base block 75 protrudes downward beyond the skirt portions 73*a*.

Within the base block 75, as a passage for ink to be supplied to the head main body 1*a*, two ink reservoirs 3 are formed each as a nearly rectangular parallelepiped space (hollow region) extending along the longitudinal direction of the base block 75. These two ink reservoirs 3 are arranged in parallel to each other at a predetermined distance in the longitudinal direction of the base block 75, by interposing a partition 75*a* arranged in the longitudinal direction of the base block 75. In the left-hand side of the lower face 75*b* of the base block 75 and at positions corresponding to the ink reservoirs 3, as shown in FIG. 3, there are formed openings 3*b* (as referred to FIG. 5), which communicate with the ink reservoirs 3. Here, these ink reservoirs 3 are connected through a not-shown supply tube with a not-shown main ink tank (ink supply source) within the printer main body. Thus, the ink reservoirs 3 are suitably supplied with ink from the main ink tank.

In the lower face 75*b* of the base block 75, the vicinity of each opening 3*b* protrudes downward from the surrounding portion. The head main body 1*a* supported on the lower side of the base block 75 is provided with actuator units 21 and a passage unit 4 bonded to the lower face of the actuator units 21. The base block 75 is in contact with a passage unit 4 (see FIG. 3) of the head main body 1*a* at only the vicinity portion 75*c* of each opening 3*b* of the lower face 75*b*. Thus, the region of the lower face 75*b* of the base block 75, other than the vicinity portion 75*c* of each opening 3*b*, is distant from the head main body 1*a*. Actuator units 21 are disposed within the distance.

To the outer side face of each holder support portion 74 of the holder 72, a driver IC 80 is fixed with an elastic member 83 such as a sponge being interposed between them. A heat sink 82 is disposed in close contact with the outer side face of the driver IC 80. The heat sink 82 is made of a nearly rectangular parallelepiped member for efficiently radiating heat generated in the driver IC 80. A flexible printed circuit (FPC) 50 as a power supply member is connected with the driver IC 80. The FPC 50, connected with the driver IC 80, is bonded to and electrically connected with the corresponding substrate 81 and the head main body 1*a* by soldering. The substrate 81 is disposed outside the FPC 50 above the driver IC 80 and the heat sink 82. The upper face of the heat sink 82 is bonded to the substrate 81 with a seal member 84. Also, the lower face of the heat sink 82 is bonded to the FPC 50 with a seal member 84.

Figure 4:
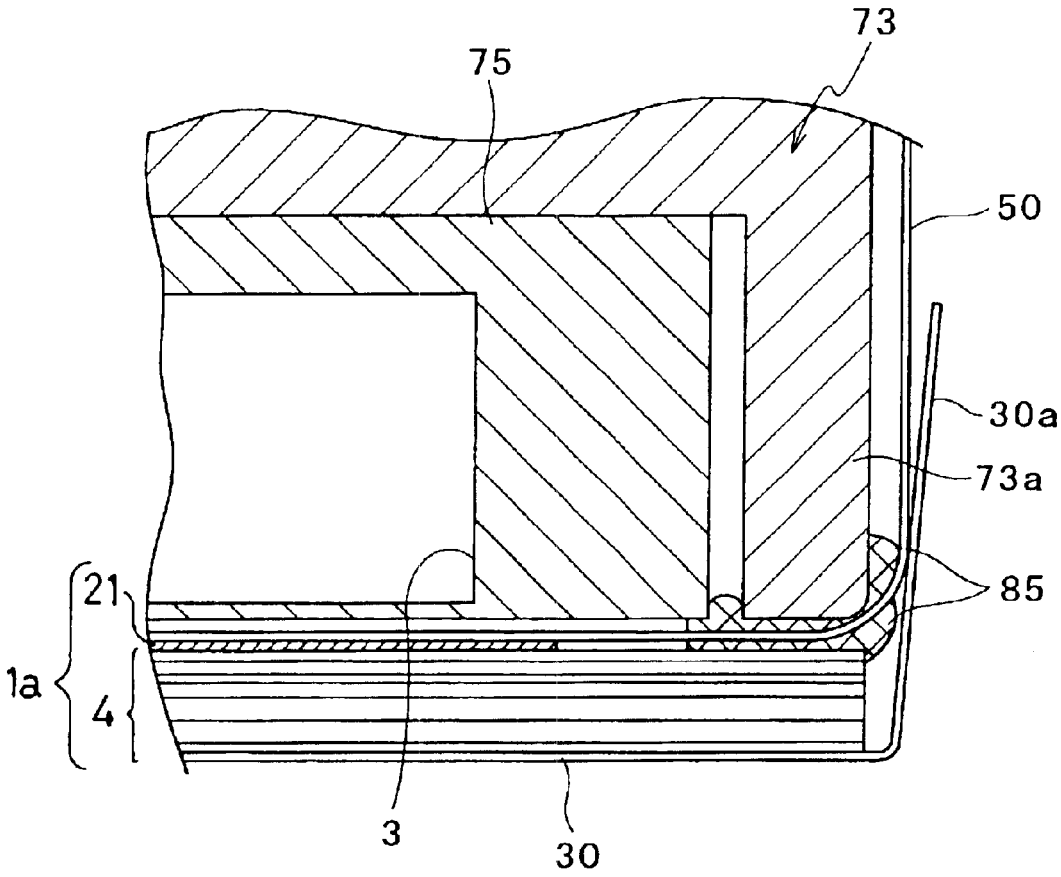
FIG. 4 is an enlarged sectional view of a neighborhood of the right-hand side end portion of the head main body of FIG. 3.

As shown in FIG. 4 presenting an enlarged sectional view of a neighborhood of the right-hand side end portion of the head main body of FIG. 3, between the lower face of each skirt portion 73*a* of the holder main body 73 and the upper face of the passage unit 4, a seal member 85 is disposed to sandwich the FPC 50. The FPC 50 is fixed by the seal member 85 to the passage unit 4 and the holder main body 73. Therefore, even if the head main body 1*a* is elongated, the head main body 1*a* can be prevented from being bent, the interconnecting portion between each actuator unit and the FPC 50 can be prevented from receiving stress, and the FPC 50 can surely be held. Even when an external force is applied to the FPC 50, therefore, the FPC 50 can hardly be peeled off the actuator unit 21, thus improving the reliability of the electric connection between the actuator unit 21 and a driver IC 80. It is also possible to suppress a force, which may be so established at the bonded portion between the actuator unit 21 and the FPC 50 when the head main body 1*a* warps in its entirety as to peel off the two. Moreover, conductive ink can be prevented from invading from the outside into the bonded portion between the actuator unit 21 and the FPC 50, so that the connected portion of the two can be prevented in advance from being electrically short-circuited.

The FPC 50 is arranged on the upper face side of the actuator unit 21, and the protrusion length of the base block 75 from its lower face 75*b* near the openings 3*b* is longer than the length between the lower face of the actuator unit 21 and the upper face of the FPC 50. In other words, a predetermined clearance is provided between the upper face of the FPC 50 and the lower face 75*b* of the base block 75, so that an external force directly applied to the bonded portion of the actuator unit 21 and the FPC 50 can be suppressed.

Referring to FIG. 2, in the vicinity of each lower corner of the ink-jet head 1 along the main scanning direction, six protruding portions 30*a* are disposed at regular intervals along the corresponding side wall of the ink-jet head 1. These protruding portions 30*a* are provided at both ends in the sub scanning direction of a nozzle plate 30 in the lowermost layer of the head main body 1*a* (see FIG. 8). The nozzle plate 30 is bent by about 90 degrees along the boundary line between each protruding portion 30*a* and the other portion. The protruding portions 30*a* are provided at positions corresponding to the vicinities of both ends of various papers to be used for printing. Each bent portion of the nozzle plate 30 has a shape not right-angled but rounded. This makes it hard to bring about clogging of a paper, i.e., jamming, which may occur because the leading edge of the paper, which has been transferred to approach the head 1, is stopped by the side face of the head 1.

Figure 5:
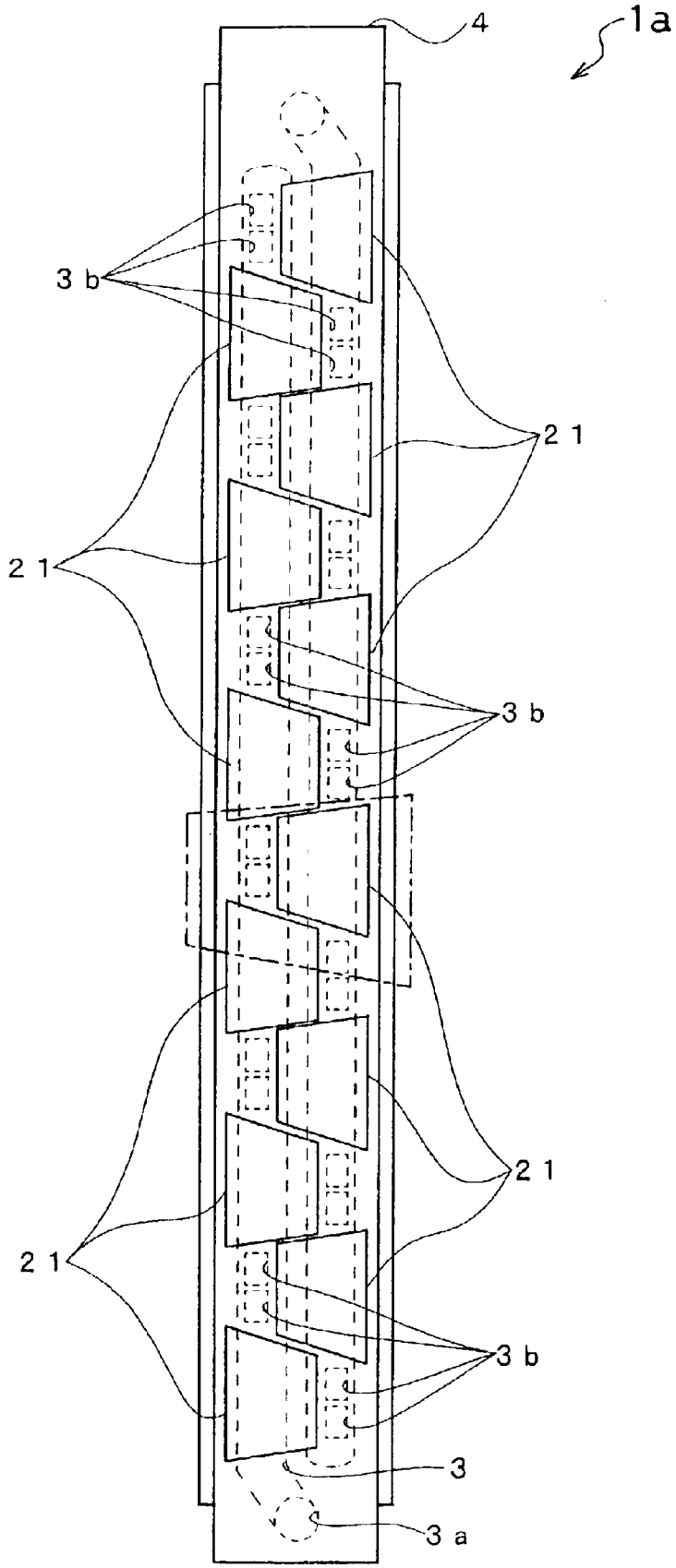
FIG. 5 is a plan view of a head main body included in the ink-jet head of FIG. 2.

FIG. 5 is a schematic plan view of the head main body 1*a*. In FIG. 5, the ink reservoirs 3 formed in the base block 75 are imaginarily illustrated with a broken line. Referring to FIG. 5, the head main body 1*a* has a rectangular shape in the plan view extending in one direction (main scanning direction). The head main body 1*a* includes a passage unit 4 in which a large number of pressure chambers 10 and a large number of ink ejection ports 8 at the front ends of nozzles (as for both, see FIGS. 6, 7, and 8) are provided, as described later. Trapezoidal actuator units 21 arranged in two lines in a zigzag manner are bonded onto the upper face of the passage unit 4. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4.

The lower face of the passage unit 4 corresponding to the bonded region of each actuator unit 4 is made into an ink ejection region. In the surface of each ink ejection region, a large number of ink ejection ports 8 are arranged in a matrix, as described later. In the base block 75 disposed above the passage unit 4, the ink reservoirs 3 are formed along the longitudinal direction of the base block 75. Each of the ink reservoirs 3 communicates with an ink tank (not illustrated) through an opening 3*a* provided at one end of the each ink reservoir 3, so that the ink reservoirs 3 are always filled up with ink. In each of the ink reservoir 3, pairs of openings 3*b* are provided in regions where no actuator unit 21 is present, so as to be arranged in a zigzag manner along the longitudinal direction of the ink reservoirs 3. Thus, the ink reservoirs 3 extend along the longitudinal direction of the passage unit 4, and the openings 3*b* are arranged at a longitudinal distance of the passage unit 4. Even in case the ink-jet head 1 is elongated, therefore, ink in the ink reservoirs 3 are stably fed to the passage unit 4 while suppressing the passage resistance.

Figure 6:
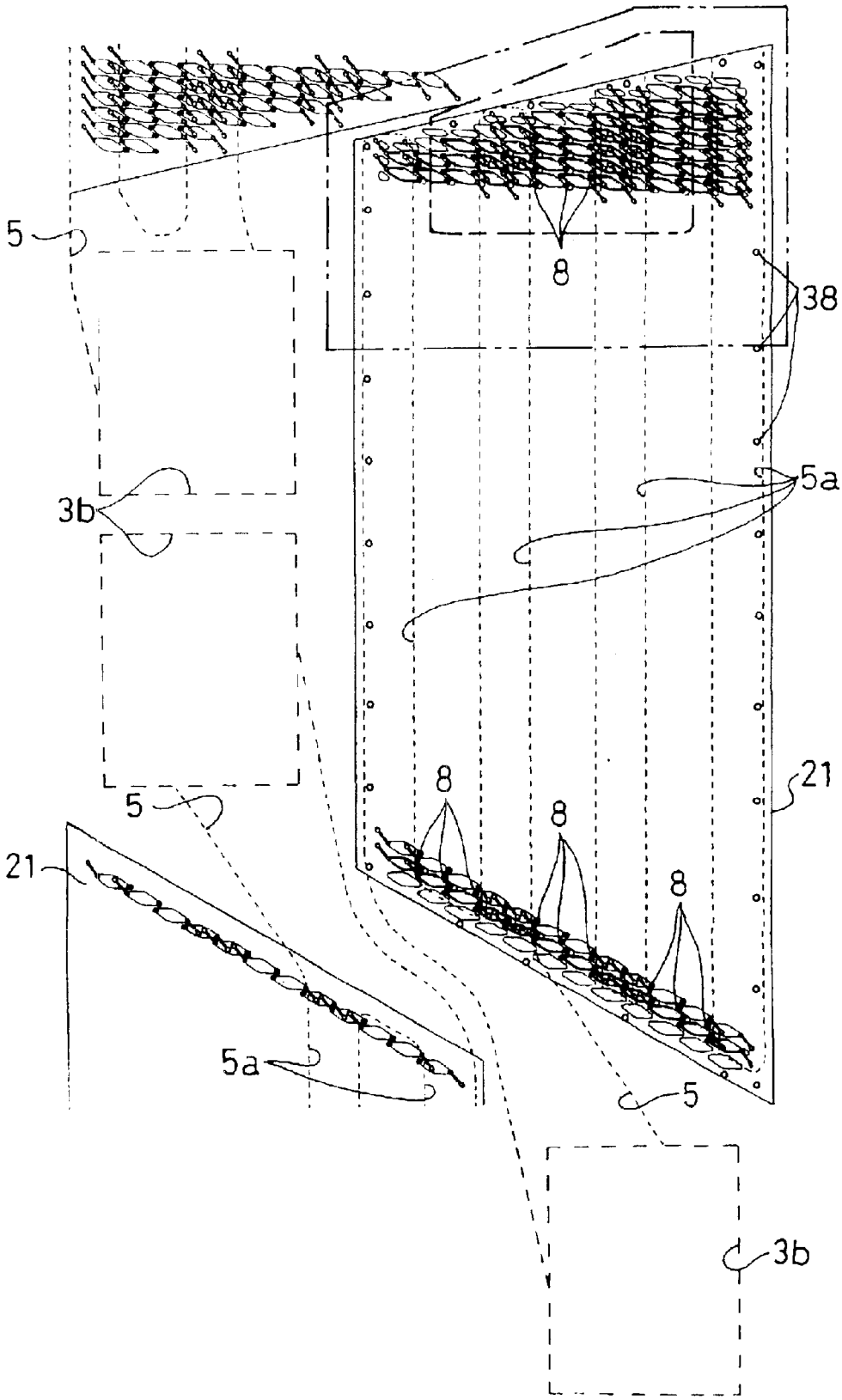
FIG. 6 is an enlarged view of the region enclosed with an alternate long and short dash line in FIG. 5.

FIG. 6 is an enlarged view of the region enclosed with an alternate long and short dash line in FIG. 5. Referring to FIGS. 5 and 6, the ink reservoirs 3 communicate through each opening 3*b* with a manifold channel 5 disposed under the opening 3*b*. Each opening 3*b* is provided with a filter (not illustrated) for catching dust and dirt contained in ink. The front end portion of each manifold channel 5 branches into two sub-manifold channels 5*a*. Below a single one of the actuator unit 21, two sub-manifold channels 5*a* extend from each of the two openings 3*b* on both sides of the actuator unit 21 in the longitudinal direction of the ink-jet head 1. That is, below the single actuator unit 21, four sub-manifold channels 5*a* in total extend along the longitudinal direction of the ink-jet head 1. Each sub-manifold channel 5*a* is filled up with ink supplied from the ink reservoir 3.

Figure 7:
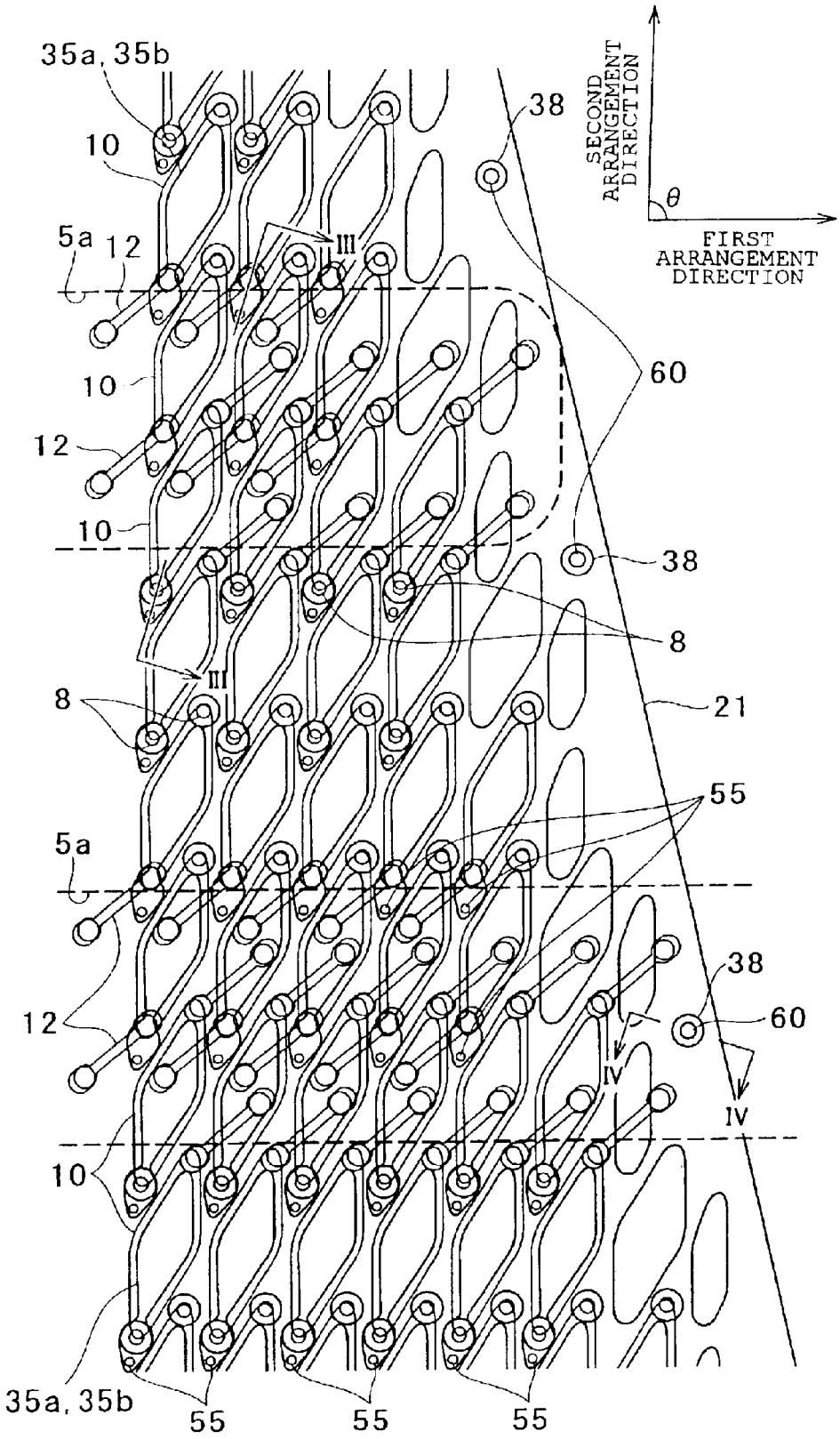
FIG. 7 is an enlarged view of the region enclosed with an alternate long and short dash line in FIG. 6.

FIG. 7 is an enlarged view of the region enclosed with an alternate long and short dash line in FIG. 6. Referring to FIGS. 6 and 7, on the upper face of each actuator unit 21, individual electrodes 35*a* each having a nearly rhombic shape in a plan view are regularly arranged in a matrix. In addition, individual electrodes 35*b* having the same shape as the individual electrodes 35*a* are disposed in the actuator unit 21 to vertically overlap the respective individual electrodes 35*a*. A large number of ink ejection ports 8 are regularly arranged in a matrix in the surface of the ink ejection region corresponding to the actuator unit 21 of the passage unit 4. In the passage unit 4, pressure chambers (cavities) 10 each having a nearly rhombic shape in a plan view somewhat larger than that of the individual electrodes 35*a* and 35*b* are regularly arranged in a matrix. Besides in the passage unit 4, apertures 12 are also regularly arranged in a matrix. These pressure chambers 10 and apertures 12 communicate with the corresponding ink ejection ports 8. The pressure chambers 10 are provided at positions corresponding to the respective individual electrodes 35*a* and 35*b*. In a plan view, the large part of the individual electrode 35*a* and 35*b* is included in a region of the corresponding pressure chamber 10. In FIGS. 6 and 7, for making it easy to understand the drawings, the pressure chambers 10, the apertures 12, etc., are illustrated with solid lines though they should be illustrated with broken lines because they are within the actuator unit 21 or the passage unit 4. Further, in FIG. 7, for convenience of explanation, feeding pads 55, 60 (see FIGS. 11A and 11B) provided in the FPC 50 and arranged on the upper face of the actuator unit 21 are drawn.

As shown in FIGS. 6 and 7, a number of ground electrodes 38 each having a circular shape and constituting peripheral electrodes are formed at the vicinity of an outer edge portion of the upper face of the actuator unit 21. The ground electrodes 38 are spaced apart from each other such that intervals between adjacent ones thereof are substantially equal. Therefore, a region in the upper face of the actuator unit 21 formed with the individual electrodes 35*a* is surrounded by a number of the ground electrodes 38 over the entire periphery thereof.

Figure 8:
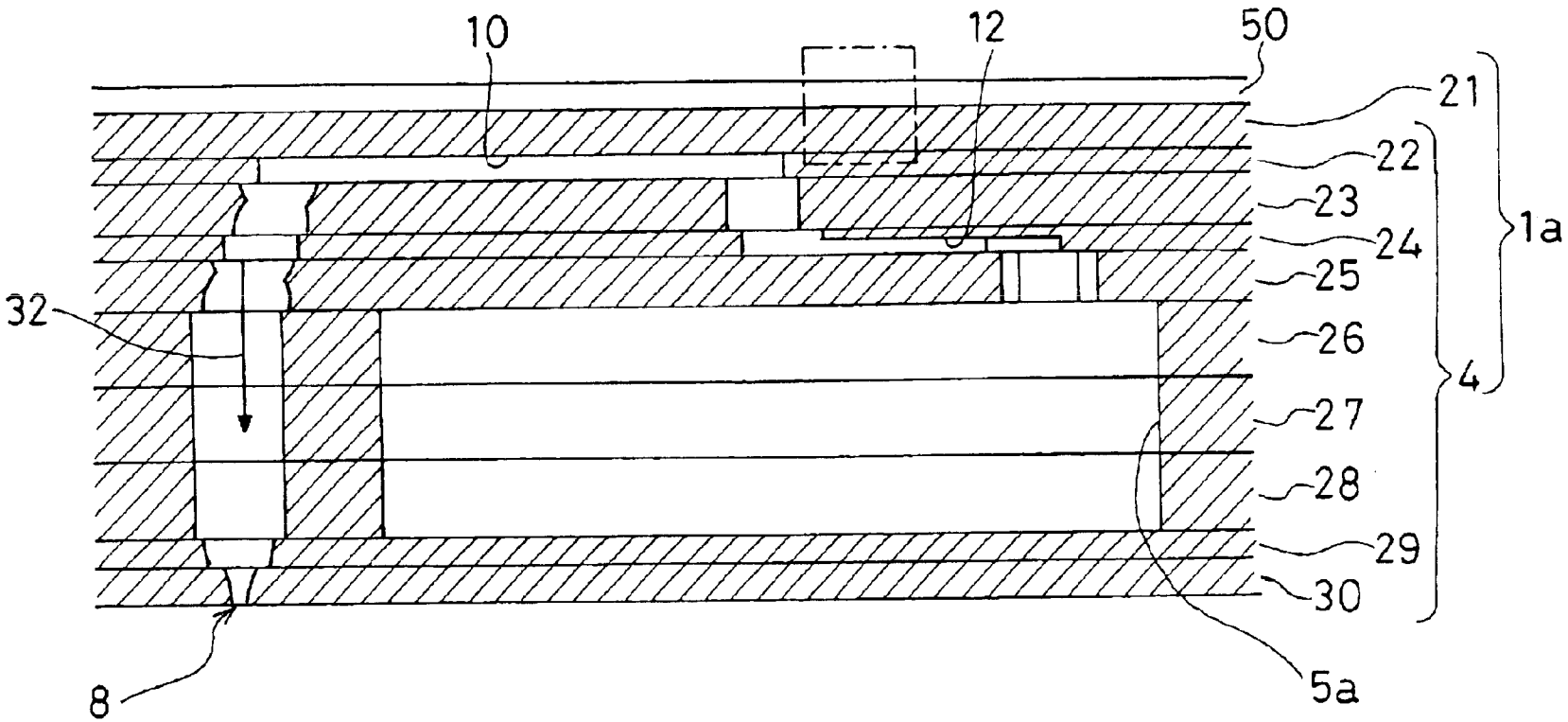
FIG. 8 is a partial sectional view of the head main body of FIG. 5 taken along line III—III in FIG. 7.

FIG. 8 is a partial sectional view of the head main body of FIG. 5 taken along line III—III in FIG. 7. As apparent from FIG. 8, each ink ejection port 8 is formed at the tip end of a tapered nozzle. Between a pressure chamber 10 and a sub-manifold channel 5*a*, an aperture 12 extends substantially in parallel with the surface of the passage unit 4, like the pressure chamber 10. This aperture 12 is for restricting the ink flow to give the passage a suitable resistance, thereby intending the stabilization of ink ejection. Each ink ejection port 8 communicates with a sub-manifold channel 5*a* through a pressure chamber 10 (length: 900 $\mu$m, width: 350 $\mu$m) and an aperture 12. Thus, within the ink-jet head 1 formed are ink passages 32 each extending from an ink tank to an ink ejection port 8 through an ink reservoir 3, a manifold channel 5, a sub-manifold channel 5*a*, an aperture 12, and a pressure chamber 10.

Referring to FIG. 8, the pressure chamber 10 and the aperture 12 are provided at different levels. Therefore, in the portion of the passage unit 4 corresponding to the ink ejection region under an actuator unit 21, an aperture 12 and a sub-manifold channel 5*a*, both communicating with one pressure chamber 10, can be disposed within the same portion in plan view as a pressure chamber 10 neighboring the pressure chamber 10 communicating with the aperture 12 and the sub-manifold channel 5*a*. As a result, since pressure chambers 10 can be arranged close to each other at a high density, image printing at a high resolution can be realized with an ink-jet head 1 having a relatively small occupation area.

In the plane of FIGS. 6 and 7, pressure chambers 10 are arranged within an ink ejection region in two directions, i.e., a direction along the length of the ink-jet head 1 (a first arrangement direction) and a direction somewhat inclining from the width of the ink-jet head 1 (a second arrangement direction). The first and second arrangement directions form an angle 'theta' somewhat smaller than the right angle. The ink ejection ports 8 are arranged at 50 dpi in the first arrangement direction. On the other hand, the pressure chambers 10 are arranged in the second arrangement direction such that the ink ejection region corresponding to one actuator unit 21 may include twelve pressure chambers 10. The shift to the first arrangement direction due to the arrangement in which twelve pressure chambers 10 are arranged in the second arrangement direction, corresponds to one pressure chamber 10. Therefore, within the whole width of the ink-jet head 1, in a region of the interval between two ink ejection ports 8 neighboring each other in the first arrangement direction, there are twelve ink ejection ports 8. At both ends of each ink ejection region in the first arrangement direction (corresponding to an oblique side of the actuator unit 21), the above condition is satisfied by making a compensation relation to the ink ejection region corresponding to the opposite actuator unit 21 in the width of the ink-jet head 1. Therefore, in the ink-jet head 1 according to this embodiment, by ejecting ink droplets in order through a large number of ink ejection ports 8 arranged in the first and second arrangement directions with relative movement of a paper along the width of the ink-jet head 1, printing at 600 dpi in the main scanning direction can be performed.

Figure 9:
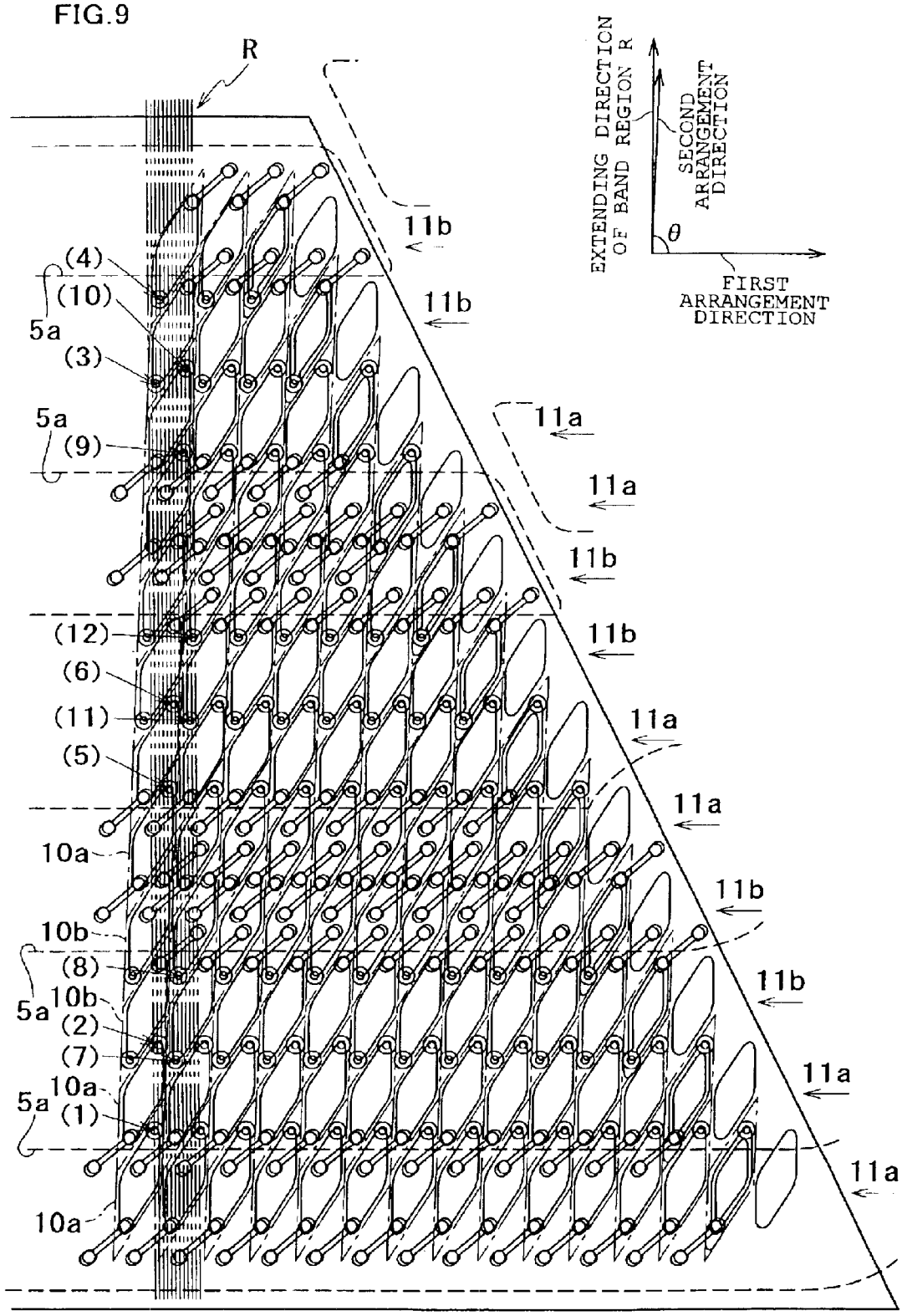
FIG. 9 is an enlarged view of the region enclosed with an alternate long and two short dashes line in FIG. 6.

Next, the construction of the passage unit 4 will be described in more detail with reference to FIG. 9. Referring to FIG. 9, pressure chambers 10 are arranged in lines in the first arrangement direction at predetermined intervals at 50 dpi. Twelve lines of pressure chambers 10 are arranged in the second arrangement direction with the pressure chambers 10 two-dimensionally arranged in the ink ejection region corresponding to one actuator unit 21.

The pressure chambers 10 are classified into two kinds, i.e., pressure chambers 10*a* in each of which a nozzle is connected with the upper acute portion in FIG. 9, and pressure chambers 10*b* in each of which a nozzle is connected with the lower acute portion. Pressure chambers 10*a* and 10*b* are arranged in the first arrangement direction to form pressure chamber rows 11*a* and 11*b*, respectively. Referring to FIG. 9, in the ink ejection region corresponding to one actuator unit 21, from the lower side of FIG. 9, there are disposed two pressure chamber rows 11*a* and two pressure chamber rows 11*b* neighboring the upper side of the pressure chamber rows 11*a*. The four pressure chamber rows of the two pressure chamber rows 11*a* and the two pressure chamber rows 11*b* constitute a set of pressure chamber rows. Such a set of pressure chamber rows is repeatedly disposed three times from the lower side in the ink ejection region corresponding to one actuator unit 21. A straight line extending through the upper acute portion of each pressure chamber in each pressure chamber rows 11*a* and 11*b* crosses the lower oblique side of each pressure chamber in the pressure chamber row neighboring the upper side of that pressure chamber row.

As described above, when viewing perpendicularly to FIG. 9, two first pressure chamber rows 11*a* and two pressure chamber rows 11*b*, in which nozzles connected with pressure chambers 10 are disposed at different positions, are arranged alternately to neighbor each other. Consequently, as the whole, the pressure chambers 10 are arranged regularly. On the other hand, nozzles are arranged in a concentrated manner in a central region of each set of pressure chamber rows constituted by the above four pressure chamber rows. Therefore, when four pressure chamber rows constitute a set of pressure chamber rows and such a set of pressure chamber rows is repeatedly disposed three times from the lower side as described above, there is formed a region where no nozzle exists, in the vicinity of the boundary between each neighboring sets of pressure chamber rows, i.e., on both sides of each set of pressure chamber rows constituted by four pressure chamber rows. Wide sub-manifold channels 5*a* extend there for supplying ink to the corresponding pressure chambers 10. In this embodiment, in the ink ejection region corresponding to one actuator unit 21, four wide sub-manifold channels 5*a* in total are arranged in the first arrangement direction, i.e., one on the lower side of FIG. 9, one between the lowermost set of pressure chamber rows and the second lowermost set of pressure chamber rows, and two on both sides of the uppermost set of pressure chamber rows.

Referring to FIG. 9, nozzles communicating with ink ejection ports 8 for ejecting ink are arranged in the first arrangement direction at regular intervals at 50 dpi to correspond to the respective pressure chambers 10 regularly arranged in the first arrangement direction. On the other hand, while twelve pressure chambers 10 are regularly arranged also in the second arrangement direction forming an angle 'theta' with the first arrangement direction, twelve nozzles corresponding to the twelve pressure chambers 10 include ones each communicating with the upper acute portion of the corresponding pressure chamber 10 and ones each communicating with the lower acute portion of the corresponding pressure chamber 10, as a result, they are not regularly arranged in the second arrangement direction at regular intervals.

If all nozzles communicate with the same-side acute portions of the respective pressure chambers 10, the nozzles are regularly arranged also in the second arrangement direction at regular intervals. In this case, nozzles are arranged so as to shift in the first arrangement direction by a distance corresponding to 600 dpi as resolution upon printing per pressure chamber row from the lower side to the upper side of FIG. 9. Contrastingly in this embodiment, since four pressure chamber rows of two pressure chamber rows 11*a* and two pressure chamber rows 11*b* constitute a set of pressure chamber rows and such a set of pressure chamber rows is repeatedly disposed three times from the lower side, the shift of nozzle position in the first arrangement direction per pressure chamber row from the lower side to the upper side of FIG. 9 is not always the same.

In the ink-jet head 1 according to this embodiment, a band region R will be discussed that has a width (about 508.0 $\mu$m) corresponding to 50 dpi in the first arrangement direction and extends perpendicularly to the first arrangement direction. In this band region R, any of twelve pressure chamber rows includes only one nozzle. That is, when such a band region R is defined at an optional position in the ink ejection region corresponding to one actuator unit 21, twelve nozzles are always distributed in the band region R. The positions of points respectively obtained by projecting the twelve nozzles onto a straight line extending in the first arrangement direction are distant from each other by a distance corresponding to 600 dpi as resolution upon printing.

When the twelve nozzles included in one band region R are denoted by (1) to (12) in order from one whose projected image onto a straight line extending in the first arrangement direction is the leftmost, the twelve nozzles are arranged in the order of (1), (7), (2), (8), (5), (11), (6), (12), (9), (3), (10), and (4) from the lower side.

In the thus-constructed inkjet head 1 according to this embodiment, by properly driving active layers in the actuator unit 21, a character, a figure, or the like, having a resolution of 600 dpi can be formed. That is, by selectively driving active layers corresponding to the twelve pressure chamber rows in order in accordance with the transfer of a print medium, a specific character or figure can be printed on the print medium.

By way of example, a case will be described wherein a straight line extending in the first arrangement direction is printed at a resolution of 600 dpi. First, a case will be briefly described wherein nozzles communicate with the same-side acute portions of pressure chambers 10. In this case, in accordance with the transfer of a print medium, ink ejection starts from a nozzle in the lowermost pressure chamber row in FIG. 9. Ink ejection is then shifted upward with the selection of a nozzle belonging to the upper neighboring pressure chamber row in order. Ink dots are thereby formed in order in the first arrangement direction while neighboring each other at 600 dpi. Finally, all the ink dots form a straight line extending in the first arrangement direction at a resolution of 600 dpi.

On the other hand, in this embodiment, ink ejection starts from a nozzle in the lowermost pressure chamber row 11*a* in FIG. 9, and ink ejection is then shifted upward with the selection of a nozzle communicating with the upper neighboring pressure chamber row in order in accordance with transfer of a print medium. In this embodiment, however, since the positional shift of nozzles in the first arrangement direction per pressure chamber row from the lower side to the upper side is not always the same, ink dots formed in order in the first arrangement direction in accordance with the transfer of the print medium are not arranged at regular intervals at 600 dpi.

More specifically, as shown in FIG. 9, in accordance with the transfer of the print medium, ink is first ejected through a nozzle (1) communicating with the lowermost pressure chamber row 11*a* in FIG. 9 to form a dot row on the print medium at intervals corresponding to 50 dpi (about 508.0 μm). After this, as the print medium is transferred and the straight line formation position has reached the position of a nozzle (7) communicating with the second lowermost pressure chamber row 11*a*, ink is ejected through the nozzle (7). The second ink dot is thereby formed at a position shifted from the first formed dot position in the first arrangement direction by a distance of six times the interval corresponding to 600 dpi (about 42.3 μm) (about 42.3 μm×6=about 254.0 μm).

Next, as the print medium is further transferred and the straight line formation position has reached the position of a nozzle (2) communicating with the third lowermost pressure chamber row 11*b*, ink is ejected through the nozzle (2). The third ink dot is thereby formed at a position shifted from the first formed dot position in the first arrangement direction by a distance of the interval corresponding to 600 dpi (about 42.3 μm). As the print medium is further transferred and the straight line formation position has reached the position of a nozzle (8) communicating with the fourth lowermost pressure chamber row 11*b*, ink is ejected through the nozzle (8). The fourth ink dot is thereby formed at a position shifted from the first formed dot position in the first arrangement direction by a distance of seven times the interval corresponding to 600 dpi (about 42.3 μm) (about 42.3 μm×7=about 296.3 μm). As the print medium is further transferred and the straight line formation position has reached the position of a nozzle (5) communicating with the fifth lowermost pressure chamber row 11*a*, ink is ejected through the nozzle (5). The fifth ink dot is thereby formed at a position shifted from the first formed dot position in the first arrangement direction by a distance of four times the interval corresponding to 600 dpi (about 42.3 μm) (about 42.3 μm×4=about 169.3 μm).

After this, in the same manner, ink dots are formed with the selecting of nozzles communicating with pressure chambers 10 in order from the lower side to the upper side in FIG. 9. In this case, when the number of a nozzle in FIG. 9 is N, an ink dot is formed at a position shifted from the first formed dot position in the first arrangement direction by a distance corresponding to (magnification n=N−1)×(interval corresponding to 600 dpi). When the twelve nozzles have been finally selected, the gap between the ink dots to be formed by the nozzles (1) in the lowermost pressure chamber rows 11*a* in FIG. 9 at an interval corresponding to 50 dpi (about 508.0 μm) is filled up with eleven dots formed at intervals corresponding to 600 dpi (about 42.3 μm). Therefore, as the whole, a straight line extending in the first arrangement direction can be drawn at a resolution of 600 dpi.

Figure 10:
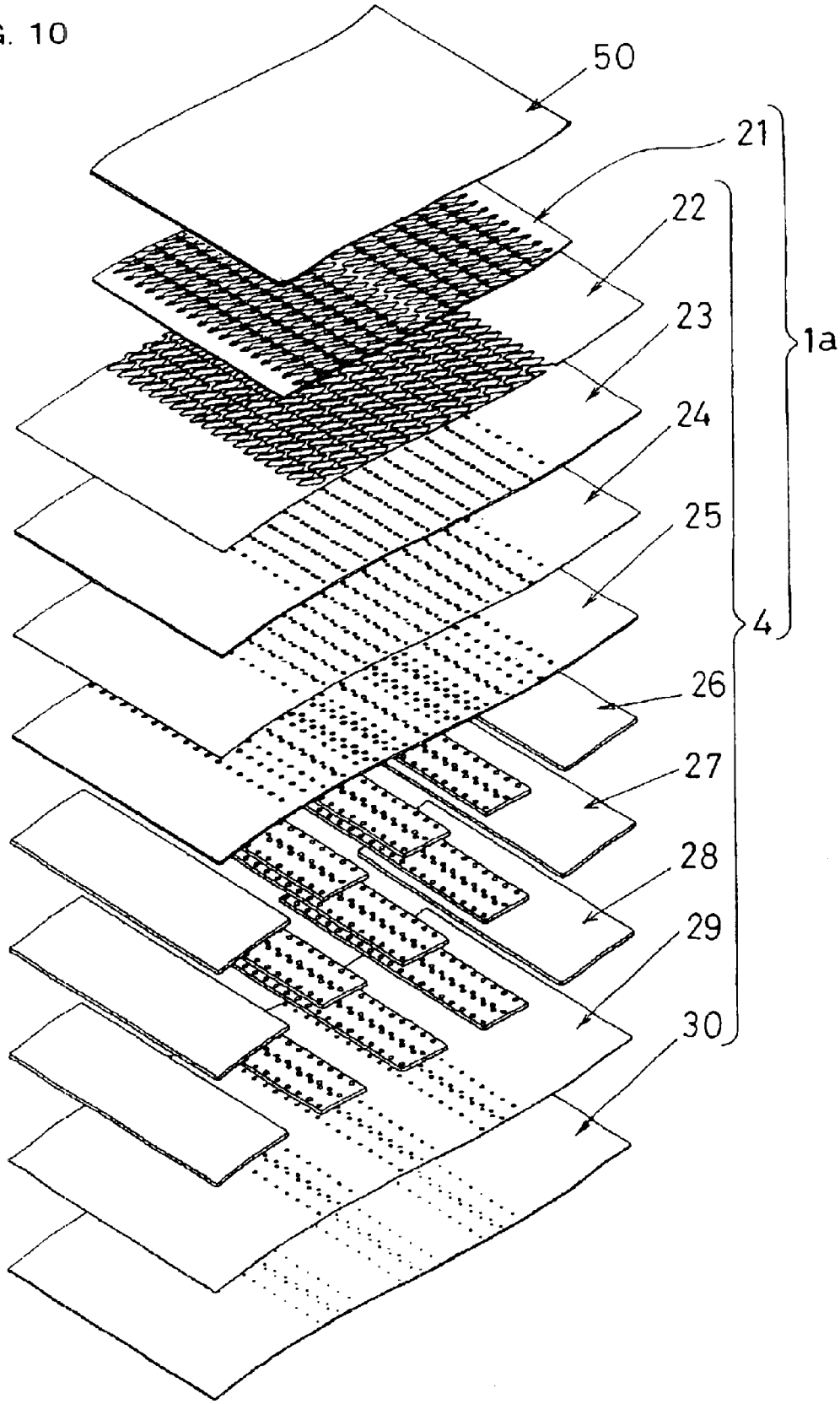
FIG. 10 is a partial exploded perspective view of the head main body of FIG. 5 and a flexible printed circuit bonded to the head main body.

FIG. 10 is a partial exploded view of the head main body 1*a* of FIG. 5 and the FPC bonded to the head main body. Referring to FIGS. 8 and 10, a principal portion on the bottom side of the ink-jet head 1 has a layered structure laminated with eleven sheet materials in total, i.e., from the top, the FPC 50, an actuator unit 21, a cavity plate 22, a base plate 23, an aperture plate 24, a supply plate 25, manifold plates 26, 27, and 28, a cover plate 29, and a nozzle plate 30. Of them, nine plates other than the actuator unit 21 constitute the passage unit 4. The passage unit 4 is constituted by two units, a nozzle plate unit having the nozzle plate 30 and a main unit having plates other than the nozzle plate 30, from the point of view of difference in the materials constructing the passage unit 4 itself.

As will be described later in detail, the actuator unit 21 is laminated with five piezoelectric sheets and provided with electrodes so that three of them may include layers to be active when an electric field is applied (hereinafter, simply referred to as "layer including active layers") and the remaining two layers may be inactive. Of the eight plates 22 to 29 constructing the main unit of the passage unit 4, the cavity plate 22 is made of metal, in which a large number of substantially rhombic openings are formed corresponding to the respective pressure chambers 10. The base plate 23 is made of metal, in which a communication hole between each pressure chamber 10 of the cavity plate 22 and the corresponding aperture 12, and a communication hole between the pressure chamber 10 and the corresponding ink ejection port 8 are formed. The aperture plate 24 is made of metal, in which, in addition to apertures 12, communication holes are formed for connecting each pressure chamber 10 of the cavity plate 22 with the corresponding ink ejection port 8. The supply plate 25 is made of metal, in which communication holes between each aperture 12 and the corresponding sub-manifold channel 5*a* and communication holes for connecting each pressure chamber 10 of the cavity plate 22 with the corresponding ink ejection port 8 are formed. Each of the manifold plates 26, 27, and 28 is made of metal, which defines an upper portion of each sub-manifold channel 5*a* and in which communication holes are formed for connecting each pressure chamber 10 of the cavity plate 22 with the corresponding ink ejection port 8. The cover plate 29 is made of metal, in which communication holes are formed for connecting each pressure chamber 10 of the cavity plate 22 with the corresponding ink ejection port 8. The nozzle plate 30 is made of metal, in which tapered ink ejection ports 8 each functioning as a nozzle are formed for the respective pressure chambers 10 of the cavity plate 22.

In this embodiment, The eight plates 22 to 29, as constructing the main unit of the passage unit 4, on the side of the actuator unit 21 are all made of stainless steel having a linear expansion coefficient of about $16.0\times10^{-6}$ (/° C.). Here, the stainless steel having a linear expansion coefficient of about $16.0\times10^{-6}$ (/° C.) is specified by SUS316. Also usable is SUS430 (having a linear expansion coefficient of about $10.4\times10^{-6}$ (/° C.)) or SUS304 (having a linear expansion coefficient of about $17.3\times10^{-6}$ (/° C.)).

On the other hand, the nozzle plate 30 located in the lowermost layer and constructing the nozzle plate unit of the passage unit 4 is made of piezoelectric ceramics of lead titanate zirconate (PZT) series having a linear expansion coefficient of about $3.0\times10^{-6}$ (/° C.). In short, the passage unit 4 is constructed of two kinds of plates each having a different linear expansion coefficient (i.e., the nozzle plate 30 and the other metal plates 22 to 29). In the nozzle plate 30, there is provided converging holes, each forming a leading end of the nozzle, corresponding to each of the pressure chamber 10 formed in the cavity plate 22. The ink ejection port 8 is formed at a lower side opening of the each converging hole (see FIG. 8).

These ten plates 21 to 30 are put in layers and are positioned to form such an ink passage 32 as illustrated in FIG. 8. The ink passage 32 first extends upward from the sub-manifold channel 5*a*, then extends horizontally in the aperture 12, then further extends upward, then again extends horizontally in the pressure chamber 10, then extends obliquely downward in a certain length to get apart from the aperture 12, and then extends vertically downward toward the ink ejection port 8. Here, the FPC 50 is so laminated as is positioned with respect to the electrodes arranged in the actuator unit 21.

Figure 11B:
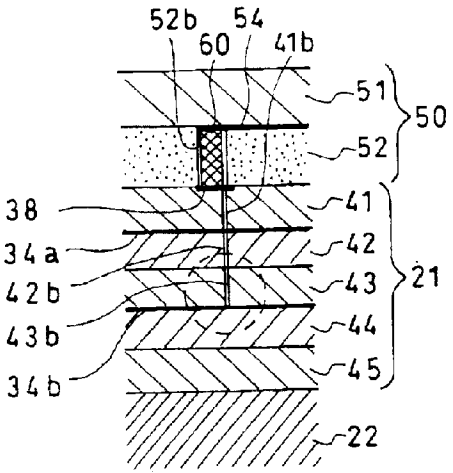
FIG. 11B is a sectional view, taken along line IV—IV illustrated in FIG. 7, of the actuator unit with the flexible printed circuit sheet disposed on the actuator unit.
Figure 11D:
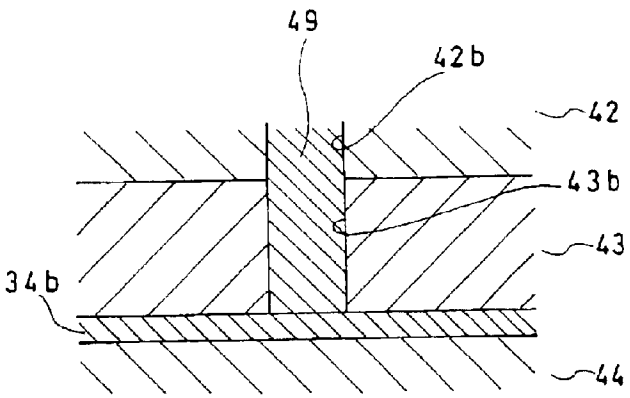
FIG. 11D is an enlarged view of the inside of around frame illustrated by an alternate long and short dash line in FIG. 11B.
Figure 11A:
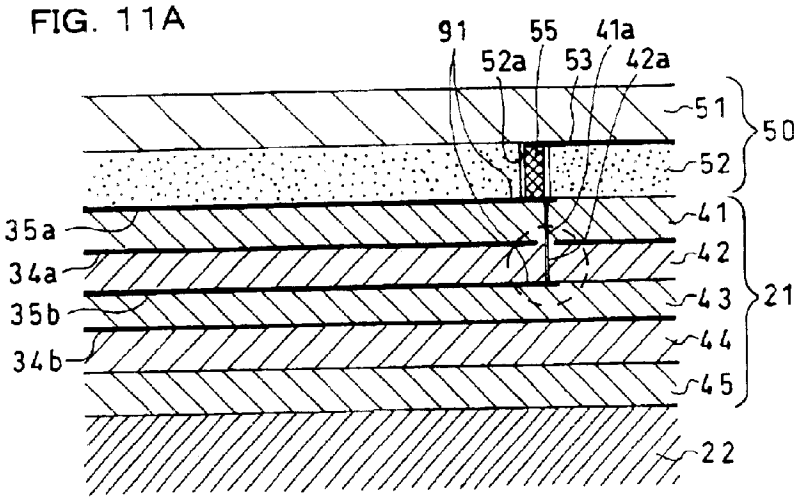
FIG. 11A is a sectional view, taken along line III—III in FIG. 7, of the actuator unit with the flexible printed circuit sheet disposed on the actuator unit, and an enlarged sectional view of the region enclosed with an alternate long and short dash line in FIG. 8.

Next, an explanation will be given of a structure of the actuator unit 21 and connection between the actuator unit 21 and the FPC 50. FIG. 11A is a sectional view, taken along line III—III in FIG. 7, of the actuator unit with the flexible printed circuit sheet disposed on the actuator unit 21, and an enlarged sectional view of the region enclosed with an alternate long and short dash line in FIG. 8. FIG. 11B is a sectional view, taken along line IV—IV illustrated in FIG. 7, of the actuator unit with the flexible printed circuit sheet disposed on the actuator unit 21.

Referring to FIGS. 11A and 11B, the actuator unit 21 includes five piezoelectric sheets 41, 42, 43, 44, and 45 having the same thickness of about 15 μm. These piezoelectric sheets 41 to 45 are made into a continuous layered flat plate (continuous flat layers) that is so disposed as to extend over many pressure chambers 10 formed within one ink ejection region in the ink-jet head 1. As a result, it is possible to retain the mechanical rigidity of the piezoelectric sheets at a high level and to enhance the response of the ink ejecting performance in the ink-jet head 1. Since the piezoelectric sheets 41 to 45 are disposed so as to extend over many pressure chambers 10 as the continuous flat layers, the individual electrodes 35*a* and 35*b* can be arranged at a high density by using, e.g., a screen printing technique. Therefore, also the pressure chambers 10 formed at positions corresponding to the individual electrodes 35*a* and 35*b* can be arranged at a high density. This makes it possible to print a high-resolution image. In this embodiment, each of the piezoelectric sheets 41 to 45 is made of a lead zirconate titanate (PZT)-base ceramic material having ferroelectricity.

In this embodiment, the piezoelectric sheets 41 to 45 are all made of piezoelectric ceramics of lead titanate zirconate (PZT) series having ferroelectricity and a linear expansion coefficient of about $3.0\times10^{-6}$ (/° C.). In short, the actuator unit 21 is made of the same material as that of the nozzle plate 30 lying in the lowermost layer of the passage unit 4.

Between the uppermost piezoelectric sheet 41 of the actuator unit 21 and the piezoelectric sheet 42 neighboring downward the piezoelectric sheet 41, an about 2 μm-thick common electrode 34*a* is interposed. The common electrode 34*a* is made of a single conductive sheet extending substantially in the whole region of the actuator unit 21. Also, between the piezoelectric sheet 43 neighboring downward the piezoelectric sheet 42 and the piezoelectric sheet 44 neighboring downward the piezoelectric sheet 43, an about 2 μm-thick common electrode 34*b* is interposed having the same shape as the common electrode 34*a*.

In a modification, many pairs of common electrodes 34*a* and 34*b*, each having a shape larger than that of a pressure chamber 10 so that the projection image of each common electrode is projected along the thickness of the common electrode, may be provided for each pressure chamber 10. In another modification, many pairs of common electrodes 34*a* and 34*b*, each having a shape somewhat smaller than that of a pressure chamber 10 so that the projection image of each common electrode is projected along the thickness of the common electrode, may be provided for each pressure chamber 10. Thus, the common electrode 34*a* or 34*b* may not always be a single conductive sheet formed on the whole of the face of a piezoelectric sheet. In the above modifications, however, all the common electrodes must be electrically connected with one another so that the portion corresponding to any pressure chamber 10 may be at the same potential.

Figure 12:
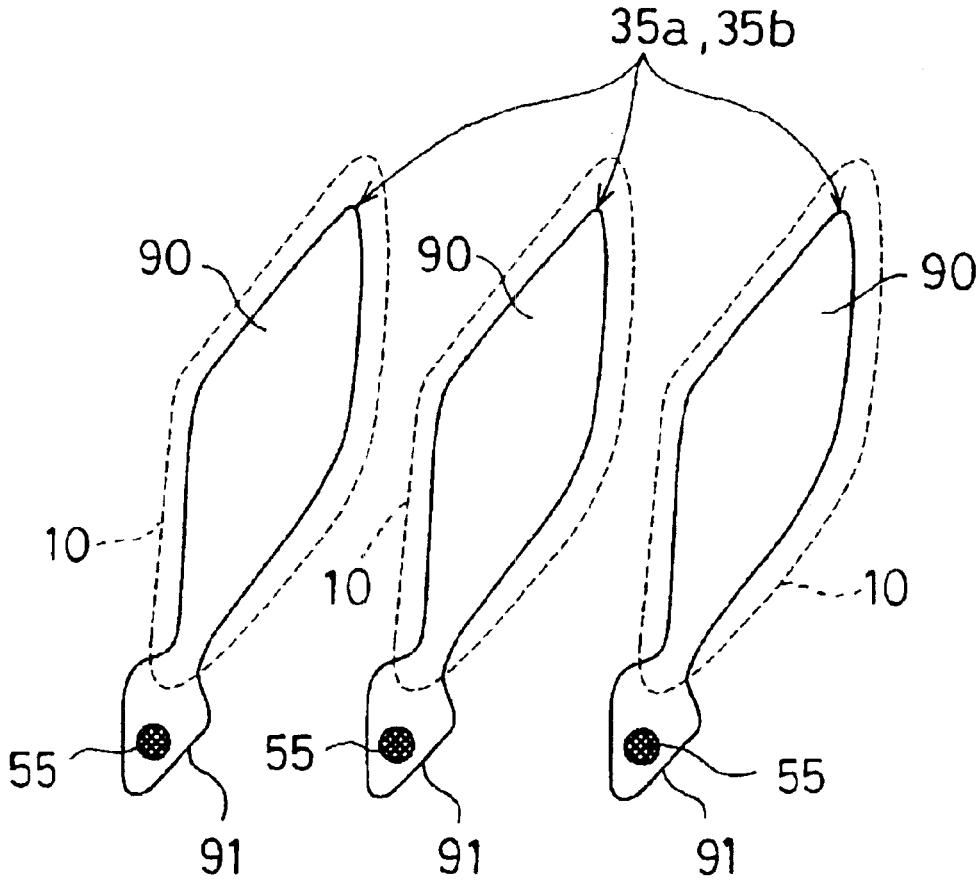
FIG. 12 is a schematic partially enlarged plan view of FIG. 7.

As shown in FIG. 11A, the individual electrode 35*a* having a thickness of about 1 micron is formed on the upper face of the piezoelectric sheets 41 at a position corresponding to the pressure chamber 10. As shown in FIG. 12, which is a schematic partially enlarged plane view of FIG. 7, the individual electrode 35*a* includes a substantially rhombic main electrode portion (length:850 microns, width:250 microns) 90 having a shape substantially similar to that of the pressure chamber 10, and one substantially rhombic auxiliary electrode portion 91 having a shape smaller than the main electrode portion 90. The auxiliary electrode portion 91 is formed continuously from an acute portion at an end thereof. The image of the main electrode portion 90 projected along the lamination direction is included within the corresponding pressure chamber region (the region surrounded by broken lines in FIG. 12). Meanwhile, the image of the auxiliary electrode portion 91 projected along the lamination direction is mostly not included in the pressure chamber region.

The individual electrode 35*b* having a shape similar to the individual electrode 35*a* and having a thickness of about 2 microns is interposed at a position, corresponding to the individual electrode 35*a*, between the piezoelectric sheet 42 and piezoelectric sheet 43. No electrode is arranged between the piezoelectric sheet 44 and the piezoelectric sheet 45 neighboring downward thereof and the lower side of the piezoelectric sheet 45.

Figure 11C:
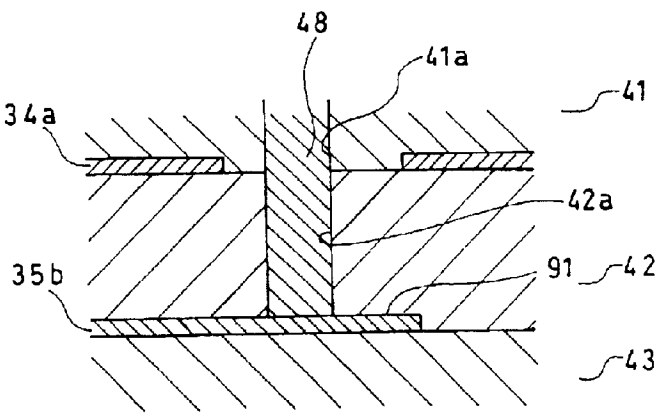
FIG. 11C is an enlarged view of the inside of around frame illustrated by an alternate long and short dash line in FIG. 11A.

As shown in FIG. 11A, through holes 41*a*, 42*a* are formed at the piezoelectric sheets 41, 42 between positions corresponding to the auxiliary electrode portions 91 of the individual electrode 35*a* and the individual electrode 35*b*. As shown in FIG. 11C, the through holes 41*a* and 42*a* are filled with a conductive material (silver palladium) 48. The individual electrode 35*a* and the individual electrode 35*b* are connected to each other via the conductive material 48 such that the connected two electrodes correspond to the same pressure chamber 10.

As shown in FIG. 11B, through holes 41*b*, 42*b*, 43*b* penetrating the piezoelectric sheets 41, 42, 43 are formed below the ground electrode 38. As shown in FIG. 11D, the through holes 41*b*, 42*b*, 43*b* are filled with a conductive material (silver palladium) 49. The ground electrode 38 is connected to the common electrode 34*a* and the common electrode 35*b* via the conductive material 49. In this embodiment, each of the electrodes 34*a*, 34*b*, 35*a*, and 35*b* is made of, e.g., an Ag—Pd-base metallic material.

The FPC 50 is a member for connecting the individual electrodes 35*a*, 35*b* and the common electrodes 34*a*, 34*b* of the actuator unit 21 to the driver IC 80. As shown in FIGS. 11A and 11B, the FPC 50 includes a number of feeding pads 55, 60 at a lower face thereof, which are electrically bonded by soldering to the individual electrode 35*a* and the ground electrode 38 arranged at the upper face of the actuator unit 21.

As shown in FIGS. 11A and 11B, the FPC 50 includes a base film 51, a cover film 52 attached to the base film 51, and printed wirings 53, 54 formed in a pattern between the two films 51, 52. The printed wirings 53, 54 are separately connected to the driver IC 80 for each pressure chamber 10. Both of the base film 51 and the cover film 52 are insulating sheet-like members. The FPC 50 is arranged such that the cover film 52 is brought into contact with the upper face of the piezoelectric sheet 41 disposed at the topmost layer of the actuator unit 21.

The cover film 52 is selectively formed with through holes 52*a*, 52*b*. In the inside of the through holes 52*a*, 52*b* the feeding pads 55, 60 made of a conductive material, having a thickness substantially the same as that of the cover film 52 are respectively provided. The feeding pads 55, 60 are respectively brought into contact with the corresponding printed wiring 53, 54 at the bottom of the recessed portion formed by the through holes 52*a*, 52*b*.

As shown in FIG. 11A, the feeding pads 55 are provided at the slightly outside of the pressure chamber 10 in the longitudinal direction, that is, at positions corresponding to the auxiliary electrode portions 91. The feeding pads 55 are electrically bonded respectively to the auxiliary electrode portions 91 by soldering. That is, in this embodiment, a single individual electrode 35*a* is electrically connected to the FPC 50 at two electric contacts (respectively disposed at positions corresponding to the each of the feeding pads 55). In this way, by electrically bonding the feeding pads 55 and the auxiliary electrode portions 91 of the individual electrode 35*a*, the electrical potential of the respective individual electrodes 35*a*, 35*b* can be controlled for each pressure chamber 10 independent from each other via the printed wiring 53 and the conductive material 48 at the insides of the through holes 41*a*, 42*a*.

On the other hand, as shown in FIG. 11B, the feeding pad 60 is provided at a position corresponding to the ground electrode 38 formed at the vicinity of an outer edge of the actuator unit 21. The feeding pad 60 is electrically bonded to the ground electrode 38 by soldering. Thereby, the electrical potential of the common electrodes 34*a*, 34*b* can be maintained at the ground potential via the printed wiring 54 and the conductive material 49 at the insides of the through holes 41*b*, 42*b*, 43*b*.

In this embodiment, all of the ground electrodes 38 are electrically bonded to the feeding pads 60 by soldering, and connected to the common electrodes 34*a*, 34*b* via the conductive material 49. However, one or several ground electrodes 38 may not be electrically bonded to the feeding pads 60, and one or several ground electrodes 38 may not be connected to the common electrodes 34*a*, 34*b*. Because the common electrode 34*a* or 34*b* is formed as one sheet of a continuous flat plate extending over all of the pressure chambers 10, when at least one of the ground electrode 38 is electrically bonded to the feeding pad 60 and connected to the common electrodes 34*a*, 34*b*, the potential of the common electrodes 34*a*, 34*b* can be maintained at the ground potential in the regions corresponding to all of the pressure chambers 10.

The printed wirings 53 and 54 are sandwiched between the base film 51 and the cover film 52, so that they can be hardly peeled off the actuator unit 21, because an external force, as might otherwise peel off the printed wirings 53 and 54 and the actuator unit 21, will be dispersed. Thus, the FPC 50 contains the printed wirings 53 and 54, so that the reliability of the electric connection between the actuator unit 21 and the driver IC 80 is improved. As shown in FIG. 7, moreover, the region having the individual electrode 35*a* formed over the piezoelectric sheet 41 is enclosed by the numerous grounding electrodes 38. No matter where the force to peel off the FPC 50 might be directed, therefore, the electric bondage between the two is hardly released by that force, so that the reliability of the electric connection between the individual electrode 35*a* and the feeding pad 55 is improved.

Here, FIGS. 11A and 11B illustrate that the upper face of the piezoelectric sheet 41 in the uppermost layer of the actuator unit 21 and the lower face of the cover film 52 of the FPC 50 abut against each other. As a matter of fact, however, a clearance is formed between the upper face of the piezoelectric sheet 41 and the lower face of the cover film 52 so that the actions of the actuator unit 21 may not be obstructed. And, only the feeding pads 55 and 60, arranged on the lower side of the cover film 52 of the FPC 50, contact with the individual electrode 35*a* or the grounding electrode 38 lying on the upper face of the piezoelectric sheet 41.

In the ink-jet head 1 according to this embodiment, the piezoelectric sheets 41 to 43 are polarized in their thickness. Therefore, the individual electrodes 35*a* and 35*b* are set at a potential different from that of the common electrodes 34*a* and 34*b* to apply an electric field in the polarization, the portions of the piezoelectric sheets 41 to 43 to which the electric field has been applied works as active layers and the portions are ready to expand or contract in thickness, i.e., in layers, and to contract or expand perpendicularly to the thickness, i.e., in a plane, by the transversal piezoelectric effect. On the other hand, since the remaining two piezoelectric sheets 44 and 45 are inactive layers having no regions sandwiched by the individual electrodes 35*a* and 35*b* and the common electrodes 34*a* and 34*b*, they can not deform in themselves. That is, the actuator unit 21 has a so-called unimorph structure in which the upper (i.e., distant from the pressure chamber 10) three piezoelectric sheets 41 to 43 are layers including active layers and the lower (i.e., near the pressure chamber 10) two piezoelectric sheets 44 and 45 are inactive layers.

Therefore, when the driver IC 80 is controlled so that an electric field is produced in the same direction as the polarization and the individual electrodes 35*a* and 35*b* are set at a positive or negative predetermined potential relative to the common electrodes 34*a* and 34*b*, active layers in the piezoelectric sheets 41 to 43 sandwiched by the individual electrodes 35*a* and 35*b* and the common electrodes 34*a* and 34*b* contract in a plane, while the piezoelectric sheets 44 and 45 do not contract in their selves. At this time, as illustrated in FIG. 11A, the lowermost face of the piezoelectric sheets 41 to 45 is fixed to the upper face of partitions partitioning pressure chambers 10 formed in the cavity plate 22, as a result, the piezoelectric sheets 41 to 45 deform into a convex shape toward the pressure chamber side by contracting in a plane by the transversal piezoelectric effect (unimorph deformation). Therefore, the volume of the pressure chamber 10 is decreased to raise the pressure of ink. The ink is thereby ejected through the ink ejection port 8. After this, when the individual electrodes 35*a* and 35*b* are returned to the original potential, the piezoelectric sheets 41 to 45 return to the original flat shape and the pressure chamber 10 also returns to its original volume. Thus, the pressure chamber 10 sucks ink therein through the manifold channel 5.

In another driving method, all the individual electrodes 35*a* and 35*b* are set in advance at a different potential from that of the common electrodes 34*a* and 34*b* so that the piezoelectric sheets 41 to 45 deform into a convex shape toward the pressure chamber 10 side. When an ejecting request is issued, the corresponding pair of individual electrodes 35*a* and 35*b* is set at the same potential as that of the common electrodes 34*a* and 34*b*. After this, at a predetermined timing, the pair of individual electrodes 35*a* and 35*b* is again set at the different potential from that of the common electrodes 34*a* and 34*b*. In this case, at the timing when the pair of individual electrodes 35*a* and 35*b* is set at the same potential as that of the common electrodes 34*a* and 34*b*, the piezoelectric sheets 41 to 45 return to their original shapes. The corresponding pressure chamber 10 is thereby increased in volume from its initial state (the state that the potentials of both electrodes differ from each other), to suck ink from the manifold channel 5 into the pressure chamber 10. After this, at the timing when the pair of individual electrodes 35*a* and 35*b* is again set at the different potential from that of the common electrodes 34*a* and 34*b*, the piezoelectric sheets 41 to 45 deform into a convex shape toward the pressure chamber 10. The volume of the pressure chamber 10 is thereby decreased and the pressure of ink in the pressure chamber 10 increases to eject ink.

In case that the polarization occurs in the reverse direction to the electric field applied to the piezoelectric sheets 41 to 43, the active layers in the piezoelectric sheets 41 to 43 sandwiched by the individual electrodes 35*a* and 35*b* and the common electrodes 34*a* and 34*b* are ready to elongate perpendicularly to the polarization. As a result, the piezoelectric sheets 41 to 45 deform into a concave shape toward the pressure chamber 10 by the transversal piezoelectric effect. Therefore, the volume of the pressure chamber 10 is increased to suck ink from the manifold channel 5. After this, when the individual electrodes 35*a* and 35*b* return to their original potential, the piezoelectric sheets 41 to 45 also return to their original flat shape. The pressure chamber 10 thereby returns to its original volume to eject ink through the ink ejection port 8.

Here will be described a method for manufacturing the head main body 1*a* of the ink-jet head 1. In order to prepare the actuator unit 21, five green sheets of piezoelectric ceramics for the piezoelectric sheets 45 to 41 are laminated at first and sintered. At the laminating time, the individual sheets are pattern-printed thereon with metal materials for the individual electrode 35*b* and the common electrodes 34*a* and 34*b*. After this sintering treatment, the piezoelectric sheet 41 is plated all over the face of the actuator unit 21 with a metallic material for the individual electrode 35*a* and is cleared of the unnecessary portion by a later patterning. Alternatively, a metallic material for the individual electrode 35*a* is vapor-deposited on the piezoelectric sheet 41 by using a mask having an opening at a portion corresponding to the individual electrode 35*a*.

The reason why only the individual electrode 35*a* is not sintered unlike the other electrode together with the ceramic material for the piezoelectric sheets 41 to 45 is that the individual electrode 35*a* is exposed and easily evaporated at the high temperature at the sintering time so that its thickness control is difficult, as compared with the remaining electrodes 34*a*, 34*b* and 35*b* coating the ceramic material. However, these remaining electrodes 34*a*, 34*b* and 35*b* are reduced more or less in thickness at the sintering time so that their thicknesses are hard to thin considering the maintenance of continuity after the sintering step. On the other hand, the individual electrode 35*a* is formed, after sintered, by the aforementioned method so that it can be made thinner than the remaining electrodes 34*a*, 34*b* and 35*b*. Thus, in the ink-jet head 1 of this embodiment, the individual electrode 35*a* in the uppermost layer is made thinner than the remaining electrodes 34*a*, 34*b* and 35*b* so that the displacements of the piezoelectric sheets 41 to 43 including the active layer are hard to regulate by the individual electrode 35*a* thereby improving the efficiency (e.g., the electric efficiency and the area efficiency) of the actuator unit 21.

When the passage unit 4 is prepared, on the other hand, the eight metal plates 22 to 29 are etched to form a number of openings and are then bonded to each other into an integral structure. Openings are formed in the nozzle plate 30 of piezoelectric ceramics by a laser patterning method. And, the passage unit 4 is prepared by arranging the nozzle plate 30 thus having the openings, on the lower side of the integrated eight metal plates 22 to 29, and by bonding and fixing the two in the heated state with a heat setting adhesive.

The actuator unit 21 and the passage unit 4 thus prepared are so bonded and fixed in the heated state with a heat setting adhesive that they are arranged in the order of the nozzle plate 30, the eight metal plates 22 to 29 and the actuator unit 21 from the lower side. Here, this work to fix the individual components is done by positioning them on the basis of the marks which are individually formed on the surface of the cavity plate 22 in the uppermost layer of the passage unit 4 and on the surface of the piezoelectric sheet 41 in the uppermost layer of the actuator unit 21. Thus, the head main body 1*a* is manufactured.

Here, the reason why the heat setting adhesive is used when the actuator unit 21 of piezoelectric ceramics and the eight upper plates in the passage unit 4 of a metal are to be fixed and when the eight upper metal plates and the piezoelectric ceramics nozzle plate are to be fixed is that the joint strength and the ink resistance are retained when the materials of different kinds are fixed.

In the ink-jet head 1 of this embodiment, as has been described hereinbefore, the actuator unit 21 and the nozzle plate 30 are made of piezoelectric ceramics having substantially equal linear expansion coefficients, and the eight metal plates 22 to 29 interposed between the actuator unit 21 and the nozzle plate 30 are made of stainless steel having a larger linear coefficient than those of the piezoelectric ceramics. This relationship is established so that the actuator unit 21 and the passage unit 4 are reduced in warp as a whole. The warp is reduced because the problem that occurs when members of different linear expansion coefficients are bonded and fixed in the heated state is lightened by bonding them in order to balance the expansion. Specifically, the expansion balance can be taken by fixing the actuator unit 21 having a linear expansion coefficient smaller than those of the metal plates 22 to 29 to one face of the metal plates 22 to 29 constructing the main unit of the passage unit 4 and by fixing the nozzle plate 30 having a linear expansion coefficient smaller than those of the metal plates 22 to 29 to the other face. Moreover, the warp is thus relaxed to lighten such problems as poor printing or deterioration in a production yield.

Both the piezoelectric ceramics constructing the actuator unit 21 and the nozzle plate 30 and the stainless steel constructing the eight plates 22 to 29, as positioned on the side of the actuator unit 21 in the passage unit 4, are the materials which are excellent in durability and heat resistance and which are suited for heating work as in this embodiment.

The actuator unit 21 can avoid the trouble of replacing its material and can be manufactured by a relatively simple manufacture process, because the piezoelectric sheets 41 to 43 containing the active layer and the piezoelectric sheets 44 and 45 containing the inactive layer are made of the identical material. Furthermore, it is possible to expect a reduction in the manufacturing costs. Additionally, all the piezoelectric sheets 41 to 43 containing the active layer and the piezoelectric sheets 44 and 45 containing the inactive layer have substantially equal thicknesses, so that the manufacturing process can be simplified to lower the cost. This is because the process of adjusting the thickness at the time when the ceramic materials for the piezoelectric sheets are applied and laminated can be simply done.

In the head main body 1*a* of the ink-jet head 1, the actuator units 21, divided so as to correspond to the ink ejection regions, are arranged in the longitudinal direction of the passage unit 4 and are bonded to the surface of the passage unit 4. As a result, the actuator units 21, which are liable to have a dispersion in the dimensional precision because they are shaped by the sintering method, can be individually positioned to the passage unit 4, so that the increase in the positional displacement between each actuator unit 21 and the passage unit 4 can be suppressed even if the head is elongated, thereby positioning the two can be achieved with high precision. Therefore, even the individual electrodes 35*a* and 35*b*, which are relatively distant from the marks are less displaced at their positions relative to the pressure chamber 10 from a predetermined position, so that a production yield of the ink-jet head 1 is drastically improved. On the other hand, when the actuator unit 21 is formed into an elongated body like the passage unit 4, the displacements of the positions of the individual electrodes 35*a* and 35*b* from the predetermined position with respect to the individual pressure chambers 10 in a plan view when the actuator unit 21 is laid over the passage unit 4 becomes larger as the distance from the marks becomes larger. Therefore, the ink ejecting performance of the pressure chamber 10 relatively distant from the marks is deteriorated to lose the homogeneity of the ink ejecting performance in the ink-jet head 1.

Further, in the actuator unit 21, since the piezoelectric sheets 41 to 43 are sandwiched by the common electrodes 34*a* and 34*b* and the individual electrodes 35*a* and 35*b*, the volume of each pressure chamber 10 can easily be changed by the piezoelectric effect. Besides, since the piezoelectric sheets 41 to 45 are made into a continuous layered flat plate (continuous flat layers), the actuator unit 21 can easily be manufactured.

Further, the ink-jet head 1 has actuator units 21 each having a unimorph structure in which the piezoelectric sheets 44 and 45 near each pressure chamber 10 are inactive and the piezoelectric sheets 41 to 43 distant from each pressure chamber 10 include active layers. Therefore, the change in volume of each pressure chamber 10 can be increased by the transversal piezoelectric effect. As a result, in comparison with an ink-jet head in which a layer including active portions is provided on the pressure chamber 10 side and a inactive layer is provided on the opposite side, lowering the voltage to be applied to the individual electrodes 35*a* and 35*b* and/or high integration of the pressure chambers 10 can be intended. By lowering the voltage to be applied, the driver for driving the individual electrodes 35*a* and 35*b* can be made small in size and the cost can be held down. In addition, each pressure chamber 10 can be made small in size. Besides, even in a case of a high integration of the pressure chambers 10, a sufficient amount of ink can be ejected. Thus, a decrease in size of the head 1 and a highly dense arrangement of printing dots can be realized.

Further, in the head main body 1*a* of the ink-jet head 1, each actuator unit 21 has a substantially trapezoidal shape. The actuator units 21 are arranged in two lines in a staggered shape so that the parallel opposed sides of each actuator unit 21 extend along the length of the passage unit 4, and the oblique sides of each neighboring actuator units 21 overlap each other in the width of the passage unit 4. Since the oblique sides of each neighboring actuator units 21 thus overlap each other, in the length of the ink-jet head 1, the pressure chambers 10 existing along the width of the passage unit 4 can compensate each other. As a result, with realizing high-resolution printing, a small-size ink-jet head 1 having a very narrow width can be realized.

Figure 13:
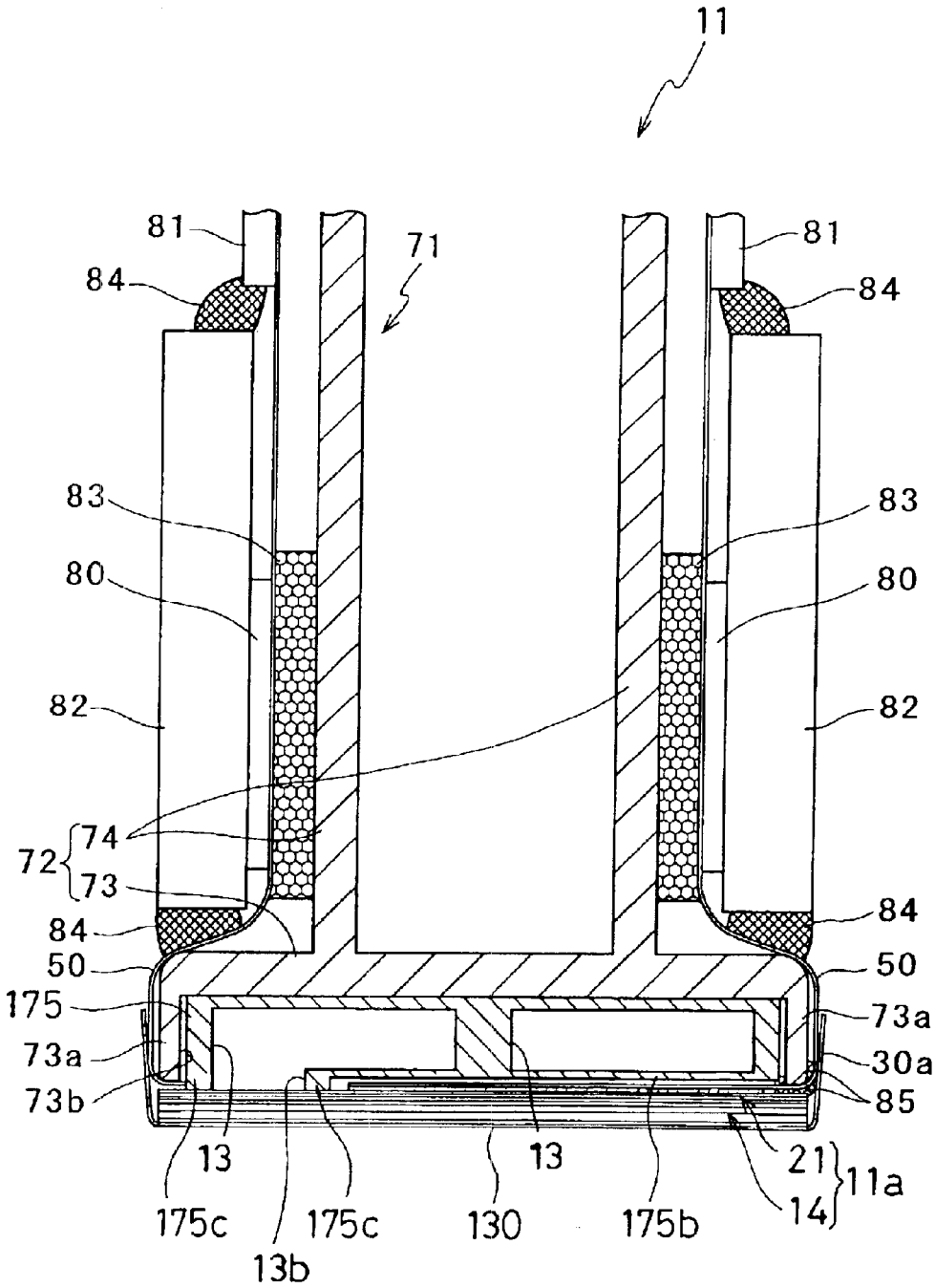
FIG. 13 is a sectional view, as corresponding to FIG. 3, of a head main body contained in an ink-jet head according to a second embodiment of the invention.
Figure 14:
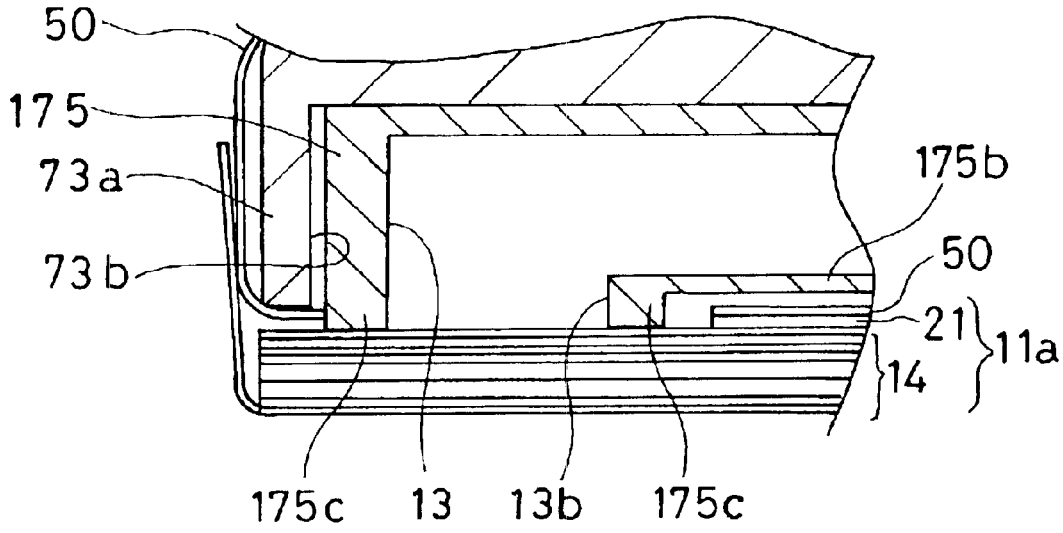
FIG. 14 is an enlarged sectional view of a neighborhood of the left-hand side end portion of the head main body of FIG. 13.
Figure 15:
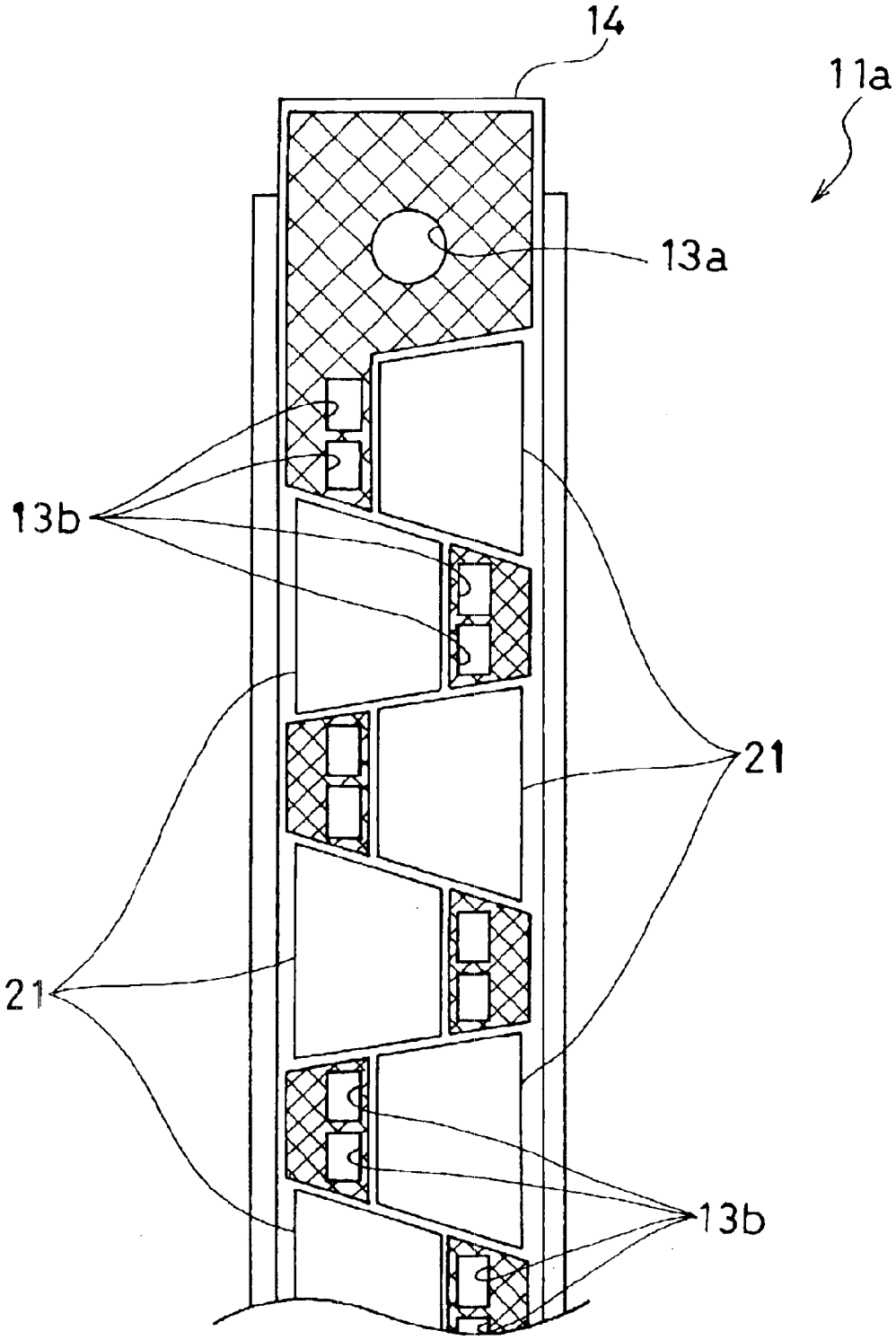
FIG. 15 is a partial plan view showing bonded regions of the base block and the passage unit of FIG. 13.

Next, an ink-jet head according to a second embodiment of the invention will be described with reference to FIGS. 13, 14 and 15. FIG. 13 is a sectional view, as corresponding to FIG. 3, of a head main body contained in an ink-jet head according to this embodiment. FIG. 14 is an enlarged sectional view of a neighborhood of the left-hand side end portion of the head main body of FIG. 13. FIG. 15 is a partial plan view showing bonded regions of the base block and the passage unit of FIG. 13. Here in this embodiment, the description the members identical to those of the first embodiment will be omitted by designating them by the common reference numerals.

The point that an ink-jet head 11 of this embodiment is different from the ink-jet head 1 of the first embodiment resides only in the materials making the base block and the head main body. In the first embodiment, the nozzle plate 30 in the lowermost layer of the passage unit 4 of the head main body 1*a* is made of piezoelectric ceramics of lead titanate zirconate (PZT) series having a linear expansion coefficient of about $3.0\times10^{-6}$ (/° C.). On the other hand, a nozzle plate 130 in this embodiment is made of stainless steel having a linear expansion coefficient of about $16.0\times10^{-6}$ (/° C.). More specifically, in this embodiment, all the nine plates constructing the passage unit 14 are made of stainless steel having a linear expansion coefficient of about $16.0\times10^{-6}$ (/° C.). In the first embodiment, moreover, no specific limitation is made to the material making the base block. However, in this embodiment, a base block 175 is made of the SUS316 having a linear expansion coefficient of about $16.0\times10^{-6}$ (/° C.).

As well seen from FIG. 14, the base block 175 is fixed like the case of the first embodiment to the passage unit 14 of the head main body 11*a* only at a portion 175*c* near an opening 13*b* of a lower face 175*b*. Therefore, the region of the lower face 175*b* of the base block 175 other than the portion near the opening 13*b* is spaced from the head main body 11*a*, and the actuator unit 21 is arranged in that space portion.

The hatched regions in FIG. 15 are bonded regions between the base block 175 and the passage unit 14. As shown in FIG. 15, the base block 175 are staggered in two rows in the longitudinal direction of the passage unit 14 and fixed in the regions of the passage unit 14, where the actuator units 21 are not fixed, while avoiding the regions of the openings 13*a* and 13*b* communicating with the ink reservoir 13 and the ink tank (not-shown). In short, the base block 175 is fixed not on the actuator unit 21 but on the passage unit 14 except the regions where the actuator units 21 are fixed. Here, the edge of the passage unit 14 without any hatching confronts the skirt portion 73*a* of the holder main body 73 shown in FIG. 13.

Next, a method for manufacturing the ink-jet head 11 according to this embodiment will be described on the points different from that of the first embodiment. In this embodiment, the nozzle plate 130 is made of not piezoelectric ceramics but stainless steel, so that it is etched to form a number of openings like the remaining metal plates 22 to 29. And, the nine metal plates 22 to 29 and 130 including the nozzle plate 130 having the openings formed are fixed by bonding them to each other without using any heat setting adhesive. As in the first embodiment, the passage unit 14 thus prepared is bonded and fixed in a heated state to the actuator unit 21 by using a heat setting adhesive. The passage unit 14 is constructed like the first embodiment such that it is supported by the base block 175 at regions where the actuator units 21 are not staggeringly fixed.

After the actuator unit 21 and the passage unit 14 are fixed to each other, the base block 175 is so fixed on the surface of the passage unit 14 as to interpose the actuator unit 21. More specifically, the portion 175*c* of the base block 175 near the opening 13*b* is bonded and fixed to the regions of the upper face of the passage unit 14 where the actuator units 21 are not bonded, in a heated state with a heat setting adhesive.

In the ink-jet head 11 of this embodiment, as described hereinbefore, the actuator unit 21 is made of the piezoelectric ceramics having a linear expansion coefficient of about $3.0\times10^{-6}$ (/° C.), and both the passage unit 14 and the base block 175 are made of the stainless steel having a linear expansion coefficient of about $16.0\times10^{-6}$ (/° C.). Therefore, when they are returned to the room temperature after bonded and fixed in the heated state, the warp, which might otherwise be caused due to the difference in the linear expansion coefficient between the passage unit 14 and the actuator unit 21, is relaxed by the support of the base block 175. This is because the expansion balance is taken as in the case of the first embodiment. Moreover, the release of the warp can lighten such problems as poor printing and deterioration in a production yield.

Moreover, the base block 175 is fixed not on the actuator unit 21 but on the passage unit 14, so that the actions of the actuator unit 21 (or the displacements of the piezoelectric sheets 41 to 45) are not obstructed. In this case, the base block 175 and the passage unit 14 support each other directly, and therefore, the warp of the passage unit 14 and the actuator unit 21 is relaxed.

As shown in FIG. 15, the actuator unit 21 and the base block 175 are so fixed on the surface of the passage unit 14 that they may be staggered from each other. Then, the warp, as might otherwise be caused due to the difference in the linear expansion coefficient between the passage unit 14 and the actuator unit 21, is more effectively relaxed. Since the actuator unit 21 has a smaller linear expansion coefficient than that of the passage unit 14, a warp convex toward the actuator unit 21 occurs in the portion of the surface of the passage unit 14 where the passage unit 14 is fixed. When the actuator units 21 are fixed in one row on the surface of the passage unit 14 in the longitudinal direction, for example, a warp occurs in an offset state concentratedly along the longitudinal portion where the actuator units 21 are fixed. This kind of offset warp is not sufficiently relaxed even if the base block 175 is fixed. On the other hand, in case the actuator units 21 are fixed in a staggered shape on the surface of the passage unit 14 and the base block 175 having a larger linear expansion coefficient than that of the actuator units 21 is staggeringly fixed on the passage unit 14 except the regions where the actuator units 21 are fixed, the warp is not offset all over the surface of the passage unit 14. As a result, the warp can be effectively relaxed. Moreover, since the warp is relaxed, such problems as poor printing and deterioration in a production yield can be lightened.

Figure 16:
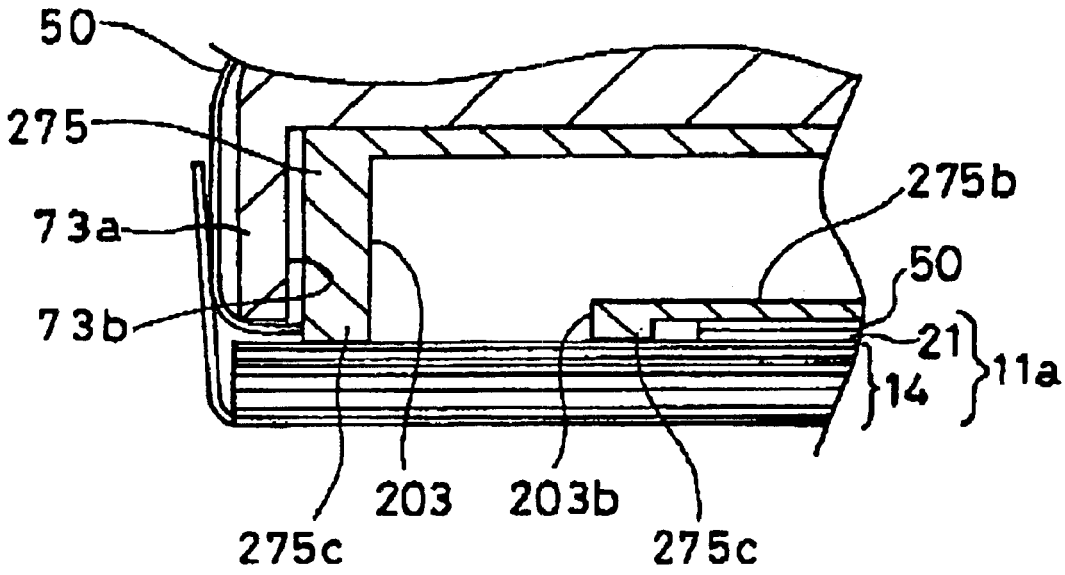
FIG. 16 is an enlarged sectional view, as corresponding to FIG. 14, of one modification of the second embodiment of the invention.
Figure 17:
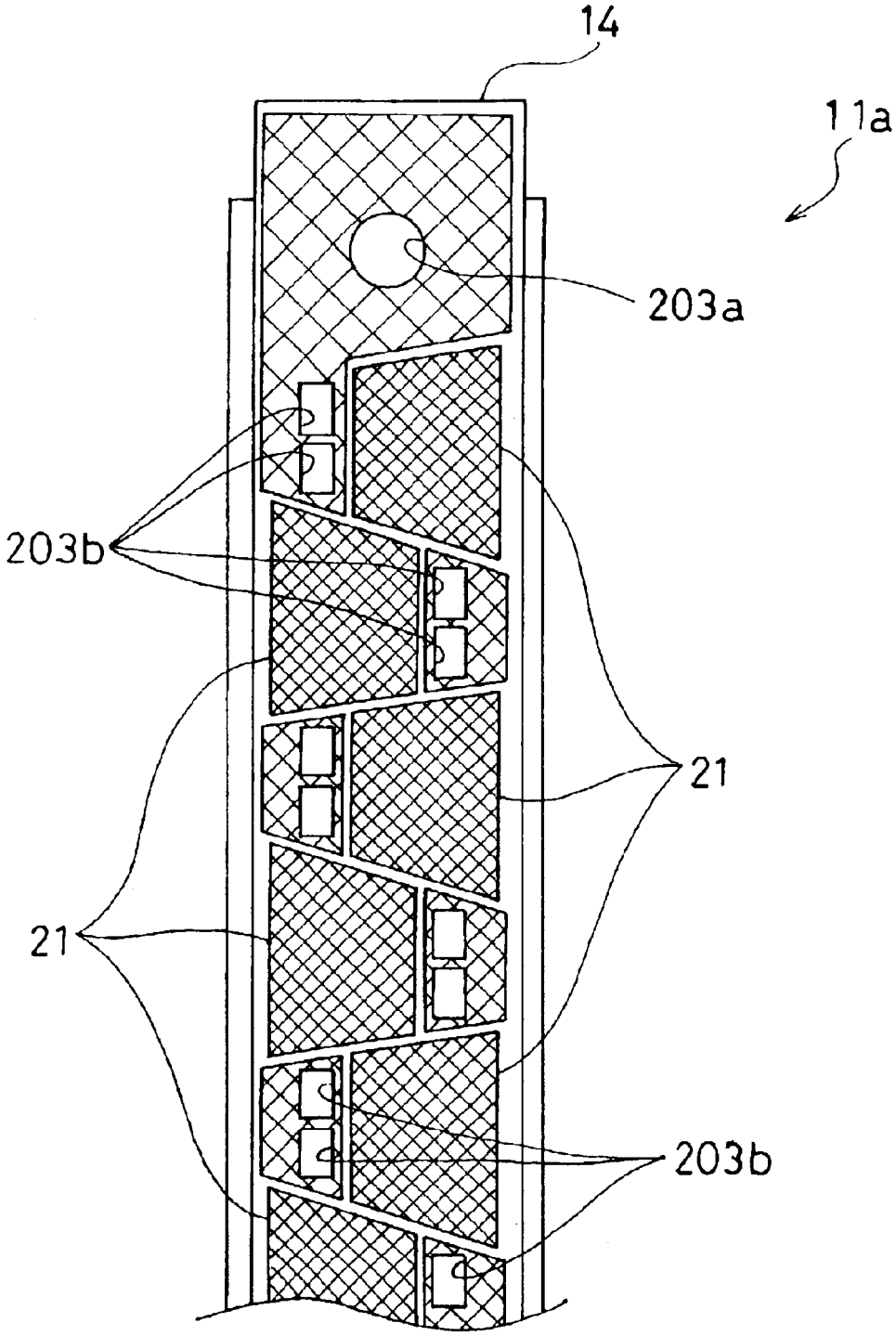
FIG. 17 is a partial plan view corresponding to FIG. 15, showing bonded regions of the base block and the passage unit and of the base block and the actuator unit in the modification of the second embodiment of the invention.

Moreover, FIGS. 16 and 17 show a modification of the second embodiment of the invention. FIG. 16 is an enlarged sectional view corresponding to FIG. 14, and FIG. 17 is a partial plan view corresponding to FIG. 15. In this modification, as shown in FIG. 16, a base block 275 is fixed on the surface of the actuator unit 21. Specifically, the base block 275 is not only fixed to the passage unit 14 at a portion 275*c* near an opening 203, but also fixed on the upper face of the actuator unit 21 at its lower face 275*b*. In FIG. 17, roughly hatched regions are bonded regions between the base block 275 and the passage unit 14, and finely hatched regions are bonded regions between the base block 275 and the actuator unit 21 while avoiding the openings 203*a*, 203*b*.

According to this modification, the displacement efficiency of the actuator unit 21 to the pressure chamber 10 can be enhanced, especially in the case of the type, in which a plurality of active layers are laminated and the longitudinal piezoelectric effect due to such active layers is used. This is because, of the displacements in the actuator unit 21 in the thickness direction, the displacement towards the base block 275 is suppressed while the displacement towards the pressure chamber 10 is augmented. In case the actuator unit is the unimorph type, however, the actuator unit and the base block are preferably neither contacted nor fixed but spaced so that the actions of the actuator unit may not be obstructed.

Here, in the first embodiment, only the nozzle plate 30 of the passage unit 4 is made of piezoelectric ceramics different from the remaining metal plates 22 to 29. However, the cover plate 29 may be made of not a metal but the piezoelectric ceramics same as the nozzle plate 30. Moreover, not only the nozzle plate 30 and the cover plate 29 but also additionally the manifold plates 26, 27 and 28 may also be made of piezoelectric ceramics.

In other words, in the first embodiment, the plates 22 to 30 constructing the passage unit 4 are coarsely classified into two units in upper and lower. One is a nozzle plate unit including at least the nozzle plate 30 and located on the side of the ink ejection port 8, and the other is a main unit constructed by the other plates and located on the side of the actuator unit 21. The plate(s) of the nozzle plate unit may be made of the piezoelectric ceramics, and the plate(s) of the main unit may be made of the stainless steel. Here, in case a plate other than the nozzle plate 30 is contained in the nozzle plate unit, that is, in case the nozzle plate unit is to be constructed by two or more plates, a method for preparing the nozzle plate unit may be exemplified either by forming holes in green sheets of piezoelectric ceramics for constructing the individual plates and afterwards laminating and sintering them integrally, or by forming holes in the individual plates and sintering them individually and then bonding them to each other.

The material for constructing the nozzle unit in the first embodiment may not be the piezoelectric ceramics of lead titanate zirconate (PZT) series but may be selected from silicon nitride, silicon carbide or 42 alloy, or combinations of these.

In the first embodiment, the materials for constructing the nozzle plate unit and the actuator unit 21 need neither always be an identical one nor have substantially equal linear expansion coefficients, as long as they have smaller linear expansion coefficients than that of the material for constructing the main unit. However, in case that the materials for constructing the nozzle plate unit and the actuator unit 21 are identical or have substantially equal linear expansion coefficients, the warp, as caused by the difference in the linear expansion coefficient, can be more effectively relaxed. Moreover, in that case, it is possible to lighten such problems as poor printing and deterioration in a production yield more reliably.

In the method for manufacturing the ink-jet head 1 according to the first embodiment, the step of fixing the actuator unit 21 and the passage unit 4 may not be limited to such a procedure such that, after the passage unit 4 is prepared by fixing the nozzle plate unit and the main unit, the actuator unit 21 is fixed on the surface of the passage unit 4. In another possible procedure, for example, the actuator unit 21 is fixed on the upper face of the main unit in the passage unit 4, and the nozzle plate unit is fixed on the lower face of the main unit. Alternatively, the actuator unit 21 and the nozzle plate unit may be simultaneously fixed on each of the two faces of the main unit of the passage unit 4.

In the second embodiment, the materials for constructing the passage unit 14 and the base block 175, 275 may not be stainless steel but may be selected from titanium, zirconia ceramics or alumina ceramics, or combinations of these.

In the second embodiment, the materials for constructing the passage unit 14 and the base block 175, 275 need neither always be an identical one nor have substantially equal linear expansion coefficients, as long as they have larger linear expansion coefficients than that of the material constructing the actuator unit 21. However, in case that the materials for constructing the passage unit 14 and the base block 175, 275 are identical or have substantially identical linear expansion coefficients, the warp, as caused by the difference in the linear expansion coefficient, can be more effectively relaxed. Moreover, in that case, it is possible to lighten such problems as poor printing and the deterioration in a production yield more reliably.

In the method for manufacturing the ink-jet head 11 according to the second embodiment, either the step of fixing the actuator unit 21 and the passage unit 14 or the step of arranging and fixing the base block 175, 275 over the face of the actuator unit 21 facing the direction opposite to the passage unit 14, may precede, or the two steps may occur simultaneously.

In the first and second embodiments, two ink reservoirs 3, 13 for passages of ink are provided in parallel in the base block 75, 175, 275, as shown in FIG. 5. However, only one ink reservoir 3, 13 may be arranged in a zigzag shape along the portion where the staggered actuator units 21 are absent. With a view to only relaxing a warp of the passage unit 4, 14 and the actuator unit 21, the ink reservoir 3, 13 for the passages of ink may not be formed in the base block 75, 175, 275.

Materials for the piezoelectric sheets and the electrodes in the actuator unit 21 may not be limited to the aforementioned ones, but may be other known ones. Further, a plan shape and a sectional shape of the pressure chamber 10 and the arrangement mode of the pressure chambers 10 may be suitably modified. For example, the pressure chambers 10 are arranged two-dimensionally in the first and second embodiments, but may be arranged linearly. Moreover, the number of piezoelectric sheets containing the active layer and the number of piezoelectric sheets containing the inactive layer can be suitably modified. Moreover, the individual thicknesses of the piezoelectric sheets containing the active layer and containing no active layer may be identical or different. Moreover, the inactive layer may be exemplified by an insulating sheet other than the piezoelectric sheet.

In the first and second embodiments, the common electrodes 34*a* and 34*b* are held at the ground potential, which is not limitative as long as it is common among the individual pressure chambers 10.

Moreover, the first and second embodiments are constructed such that the individual electrodes are disposed over the piezoelectric sheet in the uppermost layer, but the invention should not be limited thereto. For example, the piezoelectric sheet having the individual electrodes arranged thereunder and the common electrodes thereon may be arranged in the uppermost layer. Moreover, in the first and second embodiment, the actuator unit 21 is given the unimorph structure in which the inactive layer is disposed on the nearer side to the pressure chamber 10 than the active layer. However, the invention may not be limited thereto, but the active layer may be disposed on the nearer side to the pressure chamber 10 than the inactive layer, or the inactive layer may not be formed on the nearer side to the pressure chamber 10 than the active layer. Further, the piezoelectric sheets contained in the actuator unit 21 may not be the continuous flat layers disposed as to extend over the numerous pressure chambers 10 but may be formed for each pressure chamber 10.

In the first and second embodiment, the trapezoidal actuator units 21 are staggeringly arranged in two rows in the longitudinal direction on the surfaces of the passage unit 4, 14, as shown in FIGS. 5, 15, and 17. However, the actuator units may not always be trapezoidal and also may be arranged in one row in the longitudinal direction on the passage unit 4, 14. Alternatively, the actuator units may be staggeringly arranged in three or more rows.

When the members constructing the ink-jet head 1 are bonded and fixed to each other, a heat setting adhesive is used or not used depending on the position, in the aforementioned embodiments. However, a heat setting adhesive may be used for every bonded position.

In the aforementioned embodiments, the FPC 50 contains the printed wirings 53 and 54, as shown in FIGS. 11A and 11B. However, at least either the wiring for connecting the feeding pad 55 and the driver IC 80 or the wiring for grounding the feeding pad 60 to the earth may be arranged as a single signal line.

In the aforementioned embodiments, the common electrodes 34*a* and 34*b* are grounded to the earth, but this grounding is not indispensable. For example, a drive signal different from that to be fed to the individual electrodes 35*a* and 35*b* may be fed to the common electrodes 34*a* and 34*b* so that the actions of the actuator unit 21 may be optimized.

In the aforementioned embodiments, the seal member 85 is used to fix the FPC 50 with respect to the passage unit 4, 14 and the holder body 73. However, the FPC 50 may be fixed without using the seal member 85, by clamping it between the upper face of the passage unit 4, 14 and the lower face of the skirt portion 73*a* of the holder body 73, or between the upper face of the actuator unit 21 and the lower face of the skirt portion 73*a*.

While this invention has been described in conjunction with the specific embodiments outlined above, it is evident that many alternatives, modifications and variations will be apparent from those skilled in the art. Accordingly, the preferred embodiments of the invention as set forth above are intended to be illustrative, not limiting. Various changes may be made without departing from the spirit and scope of the invention as disclosed in the following claims.

What is claimed is:

1. An ink-jet head, comprising:

a passage unit, elongated in a direction, including a nozzle plate unit having a nozzle plate in which nozzles are formed, and a main unit fixed on said nozzle plate unit in a laminating direction and having a plurality of pressure chambers, each of the plurality of pressure chambers having one end connected with a nozzle and an other end connected with an ink supply source, the plurality of pressure chambers arranged along a plane to neighbor each other; and a plurality of actuator units for changing a volume of said pressure chambers, the plurality of actuator units being fixed on a side of said main unit opposite to a side on which said nozzle plate unit is fixed so as to be arranged at a distance from each other in the direction in which the passage unit is elongated, each of the actuator units having a shape that extends over the pressure chambers, wherein a linear expansion coefficient of a material making said actuator units is smaller than that of a material making said main unit, and a linear expansion coefficient of a material making said nozzle plate unit is smaller than that of the material making said main unit.

2. The ink-jet head according to claim 1, wherein the linear expansion coefficient of the material making said nozzle plate unit is substantially equal to that of the material making said actuator units.

3. The ink-jet head according to claim 1, wherein the material making said nozzle plate unit and the material making said actuator units are identical.

4. The ink-jet head according to claim 1, wherein said nozzle plate unit is made of at least one material selected from the group consisting of silicon nitride, silicon carbide, and 42 alloy.

5. A method for manufacturing an ink-jet head with a passage unit elongated in a direction including a nozzle plate unit having a nozzle plate in which nozzles are formed and a main unit having a plurality of pressure chambers, each of the plurality of pressure chambers having one end connected with a nozzle and an other end connected with an ink supply source, the plurality of pressure chambers arranged along a plane to neighbor each other; and a plurality of actuator units for changing a volume of said pressure chambers, comprising:

fixing said nozzle plate unit and said main unit, with the main unit made of a material having a linear expansion coefficient larger than that of a material making said nozzle plate unit, in a heated state in a laminating direction; and fixing said actuator units, with the actuator units made of a material having a linear expansion coefficient smaller than that of the material making said main unit, on a side of said main unit opposite to a side on which said nozzle plate unit is fixed, so as to be arranged at a distance from each other in the direction in which the passage unit is elongated, and for each of the actuator units to have a shape that extends over the pressure chambers, in a heated state.

6. An ink-jet printer having an ink-jet head, comprising:

a passage unit, elongated in a direction including a nozzle plate unit having a nozzle plate in which nozzles are formed, and a main unit fixed on said nozzle plate unit in a laminating direction and having a plurality of pressure chambers, each of the plurality of pressure chambers having one end connected with a nozzle and an other end connected with an ink supply source, the plurality of pressure chambers arranged along a plane to neighbor each other; and a plurality of actuator units for changing a volume of said pressure chambers, the plurality of actuator units being fixed on a side of said main unit opposite to a side on which said nozzle plate unit is fixed so as to be arranged at a distance from each other in the direction in which the passage unit is elongated, each of the actuator units having a shape that extends over the pressure chambers, wherein a linear expansion coefficient of a material making said actuator units is smaller than that of a material making said main unit, and a linear expansion coefficient of a material making said nozzle plate unit is smaller than that of the material making said main unit.

7. An ink-jet head, comprising:

a passage unit including a plurality of pressure chambers each having one end connected with a nozzle and an other end connected with an ink supply source, the plurality of pressure chambers being arranged along a plane to neighbor each other;

an actuator unit fixed on a surface of said passage unit for changing a volume of said pressure chambers; and a support member having an ink reservoir filled up with ink and an ink passage for feeding ink from the ink reservoir to said passage unit formed therein, the support member arranged over a plane of the actuator unit and facing a direction opposite to said passage unit, wherein a linear expansion coefficient of a material making said passage unit is larger than that of a material making said actuator unit, and a linear expansion coefficient of a material making said support member is larger than that of the material making said actuator unit.

8. The ink-jet head according to claim 7, wherein said support member is not fixed on said actuator unit, and said support member is fixed on said passage unit except for a region where said actuator unit is fixed on the passage unit.

9. The ink-jet head according to claim 7, wherein said support member is fixed on said actuator unit.

10. The ink-jet head according to claim 7, wherein the linear expansion coefficient of the material making said passage unit is substantially equal to that of the material making said support member.

11. The ink-jet head according to claim 7, wherein the material making said passage unit and the material making said support member are identical.

12. The ink-jet head according to claim 7, wherein said actuator unit is made of piezoelectric ceramics, and each of said passage unit and said support member is made of at least one material selected from the group consisting of stainless steel, titanium, zirconia ceramics and alumina ceramics.

13. The ink-jet head, according to claim 7, wherein the passage unit is elongated in a direction, a plurality of actuator units are arranged at a distance from each other in the direction in which the passage unit is elongated, and each of the actuator units has a shape that extends over the pressure chambers.

14. A method for manufacturing an ink-jet head with a passage unit including a plurality of pressure chambers each having one end connected with a nozzle and an other end connected with an ink supply source, the plurality of pressure chambers being arranged along a plane to neighbor each other and an actuator unit for changing the volume of said pressure chambers, comprising:

fixing said actuator unit, which is made of a material having a linear expansion coefficient smaller than that of a material making said passage unit, in a heated state on a surface of said passage unit; and arranging a support member having an ink reservoir filled up with ink and an ink passage for feeding ink from the ink reservoir to said passage unit formed therein, which is made of a material having a larger linear expansion coefficient than that of the material making said actuator unit, over a plane of the actuator unit and facing a direction opposite to said passage unit.

15. The method according to claim 14, wherein the passage unit is elongated in a direction, a plurality of actuator units are arranged at a distance from each other in the direction in which the passage unit is elongated, and each of the actuator units has a shape that extends over the pressure chambers.

16. An ink-jet printer having an ink-jet head, comprising:

a passage unit including a plurality of pressure chambers each having one end connected with a nozzle and an other end connected with an ink supply source, the plurality of pressure chambers being arranged along a plane to neighbor each other;

an actuator unit fixed on a surface of said passage unit for changing a volume of said pressure chambers; and a support member having an ink reservoir filled up with the ink and an ink passage for feeding ink from the ink reservoir to said passage unit formed therein, the support member arranged over a plane of the actuator unit and facing a direction opposite to said passage unit, wherein a linear expansion coefficient of a material making said passage unit is larger than that of a material making said actuator unit, and a linear expansion coefficient of a material making said support member is larger than that of the material making said actuator unit.

17. The ink-jet printer according to claim 16, wherein the passage unit is elongated in a direction, a plurality of actuator units are arranged at a distance from each other in the direction in which the passage unit is elongated, and each of the actuator units has a shape that extends over the pressure chambers.

18. An ink-jet head, comprising:

a passage unit including a plurality of pressure chambers each having one end connected with a nozzle and an other end connected with an ink supply source, the plurality of pressure chambers being arranged along a plane to neighbor each other;

actuator units fixed in a staggered shape on a surface of said passage unit for changing the volume of said pressure chambers; and a support member arranged over a plane of the actuator units and facing a direction opposite to said passage unit and having a plurality of staggeringly arranged fixing portions fixed on a surface of said passage unit except for a region where said actuator units are fixed on the passage unit, wherein said fixing portions of said support member and said actuator units are arranged adjacent to each other on said surface of said passage unit, and a linear expansion coefficient of a material making said passage unit is larger than that of a material making said actuator units, and a linear expansion coefficient of a material making said support member is larger than that of the material making said actuator units.

19. The ink-jet head according to claim 18, wherein the linear expansion coefficient of the material making said passage unit is substantially equal to that of the material making said support member.

20. The ink-jet head according to claim 18, wherein the material making said passage unit and the material making said support member are identical.

21. The ink-jet head according to claim 18, wherein said actuator units are made of piezoelectric ceramics, and said passage unit and said support member are made of at least one material selected from the group consisting of stainless steel, titanium, zirconia ceramics and alumina ceramics.

22. The ink-jet head according to claim 18, wherein an ink passage for feeding ink to said passage unit is formed in said support member.

23. A method for manufacturing an ink-jet head with a passage unit including a plurality of pressure chambers each having one end connected with a nozzle and an other end connected with an ink supply source, the plurality of pressure chambers being arranged along a plane to neighbor each other, actuator units for changing a volume of said pressure chambers and a support member arranged over a plane of the actuator units and facing a direction opposite to said passage unit, comprising:

fixing said actuator units, which are made of a material having a linear expansion coefficient smaller than that of a material making said passage unit, in a heated state so that they are arranged in a staggered shape on a surface of said passage unit; and fixing said support member, which is made of a material having a linear expansion coefficient larger than that of the material making said actuator units, on said passage unit except for a region where said actuator units are fixed on the passage unit so that a plurality of fixing portions are arranged in a staggered shape on said surface of said passage unit.

24. An ink-jet printer having an ink-jet head, comprising:

a passage unit including a plurality of pressure chambers each having one end connected with a nozzle and an other end connected with an ink supply source, the plurality of pressure chambers being arranged along a plane to neighbor each other;

actuator units fixed in a staggered shape on a surface of said passage unit for changing the volume of said pressure chambers; and a support member arranged over a plane of the actuator units and facing a direction opposite to said passage unit and having a plurality of staggeringly arranged fixing portions fixed on a surface of said passage unit except for a region where said actuator units are fixed on the passage unit, wherein said fixing portions of said support member and said actuator units are arranged adjacent to each other on said surface of said passage unit, and a linear expansion coefficient of a material making said passage unit is larger than that of a material making said actuator units, and a linear expansion coefficient of a material making said support member is larger than that of the material making said actuator units.

* * * * *